US007669662B2

(12) United States Patent
Pietras

(10) Patent No.: US 7,669,662 B2
(45) Date of Patent: Mar. 2, 2010

(54) CASING FEEDER

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 684 days.

(21) Appl. No.: 11/185,281

(22) Filed: Jul. 20, 2005

(65) Prior Publication Data

US 2006/0000600 A1 Jan. 5, 2006

Related U.S. Application Data

(63) Continuation-in-part of application No. 10/738,950, filed on Dec. 17, 2003, now Pat. No. 7,021,374, which is a continuation of application No. 10/354,226, filed on Jan. 29, 2003, now Pat. No. 6,688,398, which is a continuation of application No. 09/762,698, filed as application No. PCT/GB99/02704 on Aug. 16, 1999, now Pat. No. 6,527,047.

(60) Provisional application No. 60/589,495, filed on Jul. 20, 2004.

(30) Foreign Application Priority Data

Aug. 24, 1998 (GB) ..... 9818366

(51) Int. Cl.
*E21B 19/00* (2006.01)

(52) U.S. Cl. ..... 166/381; 166/77.1; 166/380

(58) Field of Classification Search ..... 166/77.1, 166/78.1, 380, 381

See application file for complete search history.

(56) References Cited

U.S. PATENT DOCUMENTS

| | | | |
|---|---|---|---|
| 179,973 | A | 7/1876 | Thornton |
| 1,418,766 | A | 6/1922 | Wilson |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,842,638 | A | 1/1932 | Wigle |
| 1,917,135 | A | 7/1933 | Littell |

(Continued)

FOREIGN PATENT DOCUMENTS

| | | |
|---|---|---|
| CA | 2 307 386 | 11/2000 |

(Continued)

OTHER PUBLICATIONS

EP Search Report, Application No. 05015598-2315, dated Jan. 19, 2006.

(Continued)

*Primary Examiner*—Shane Bomar
(74) *Attorney, Agent, or Firm*—Patterson & Sheridan, LLP

(57) ABSTRACT

A top drive system for drilling with casing includes a casing feeder and a torque head. In one embodiment, the casing feeder is adapted to position a casing for engagement with the torque head. The casing feeder includes a pair of conveying arms for engagement with the casing. Each conveying arm may be raised or lowered by a cylinder. The conveying arms are equipped with a motor driven roller for engaging and lifting the casing. The casing feeder may also be equipped with a counting apparatus to determine the positioning of the casing in the torque head.

42 Claims, 23 Drawing Sheets

U.S. PATENT DOCUMENTS

| | | | |
|---|---|---|---|
| 2,105,885 | A | 1/1938 | Hindertiter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |
| 2,610,690 | A | 9/1952 | Beatty |
| 2,641,444 | A | 6/1953 | Moon |
| 2,688,689 | A | 2/1954 | Cormany |
| 2,692,059 | A | 10/1954 | Bolling, Jr. |
| 2,953,406 | A | 9/1960 | Young |
| 2,965,177 | A | 12/1960 | Le Bus Sr., et al. |
| 3,041,901 | A | 7/1962 | Knights |
| 3,087,546 | A | 4/1963 | Wooley |
| 3,122,811 | A | 3/1964 | Gilreath |
| 3,193,116 | A | 7/1965 | Kenneday et al. |
| 3,266,582 | A | 8/1966 | Homanick |
| 3,380,528 | A | 4/1968 | Timmons |
| 3,392,609 | A | 7/1968 | Bartos |
| 3,477,527 | A | 11/1969 | Koot |
| 3,489,220 | A | 1/1970 | Kinley |
| 3,518,903 | A | 7/1970 | Ham, at al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,606,684 | A | 9/1971 | Weiner |
| 3,635,105 | A | 1/1972 | Dickmann et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,700,048 | A | 10/1972 | Desmoulins |
| 3,706,347 | A | 12/1972 | Brown |
| 3,746,330 | A | 7/1973 | Taciuk |
| 3,747,675 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi, et al. |
| 3,915,244 | A | 10/1975 | Brown |
| 3,964,552 | A | 6/1976 | Slator |
| 3,980,143 | A | 9/1976 | Swartz et al. |
| 4,054,332 | A | 10/1977 | Bryan, Jr. |
| 4,077,525 | A | 3/1978 | Callegari et al. |
| 4,100,968 | A | 7/1978 | Delano |
| 4,127,927 | A | 12/1978 | Hauk et al. |
| 4,142,739 | A | 3/1979 | Billingsley |
| 4,202,225 | A | 5/1980 | Sheldon et al. |
| 4,221,269 | A | 9/1980 | Hudson |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,280,380 | A | 7/1981 | Eshghy |
| 4,315,553 | A | 2/1982 | Stallings |
| 4,320,915 | A | 3/1982 | Abbott et al. |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| 4,489,794 | A | 12/1984 | Boyadjieff |
| 4,492,134 | A | 1/1985 | Reinhldt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,570,706 | A | 2/1986 | Pugnet |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,646,827 | A | 3/1987 | Cobb |
| 4,649,777 | A | 3/1987 | Buck |
| 4,652,195 | A | 3/1987 | McArthur |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,725,179 | A | 2/1988 | Woolslayer et al. |
| 4,735,270 | A | 4/1988 | Fenyvesi |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |
| 4,781,359 | A | 11/1988 | Matus |
| 4,791,997 | A | 12/1988 | Krasnov |
| 4,793,422 | A | 12/1988 | Krasnov |
| 4,800,968 | A | 1/1989 | Shaw et al. |
| 4,813,493 | A | 3/1989 | Shaw et al. |
| 4,813,495 | A | 3/1989 | Leach |
| 4,821,814 | A | 4/1989 | Willis et al. |
| 4,832,552 | A | 5/1989 | Skelly |
| 4,836,064 | A | 6/1989 | Slator |
| 4,843,945 | A | 7/1989 | Dinsdale |
| 4,867,236 | A | 9/1989 | Haney et al. |
| 4,878,546 | A | 11/1989 | Shaw et al. |
| 4,899,816 | A | 2/1990 | Mine |
| 4,909,741 | A | 3/1990 | Schasteen et al. |
| 4,921,386 | A | 5/1990 | McArthur |
| 4,936,382 | A | 6/1990 | Thomas |
| 4,962,579 | A | 10/1990 | Moyer et al. |
| 4,962,819 | A | 10/1990 | Bailey et al. |
| 4,971,146 | A | 11/1990 | Terrell |
| 4,997,042 | A | 3/1991 | Jordan et al. |
| 5,022,472 | A | 6/1991 | Bailey et al. |
| 5,036,927 | A | 8/1991 | Willis |
| 5,049,020 | A | 9/1991 | McArthur |
| 5,060,542 | A | 10/1991 | Hauk |
| 5,062,756 | A | 11/1991 | McArthur et al. |
| 5,107,940 | A | 4/1992 | Berry |
| 5,111,893 | A | 5/1992 | Kvello-Aune |
| RE34,063 | E | 9/1992 | Vincent et al. |
| 5,191,939 | A | 3/1993 | Stokley |
| 5,233,742 | A | 8/1993 | Gray et al. |
| 5,234,053 | A * | 8/1993 | Connell ..... 166/250.01 |
| 5,245,265 | A | 9/1993 | Clay |

| | | | |
|---|---|---|---|
| 5,251,709 | A | 10/1993 | Richardson |
| 5,255,751 | A | 10/1993 | Stogner |
| 5,272,925 | A | 12/1993 | Henneuse et al. |
| 5,282,653 | A | 2/1994 | LaFleur et al. |
| 5,284,210 | A | 2/1994 | Helms et al. |
| 5,294,228 | A | 3/1994 | Willis et al. |
| 5,297,833 | A | 3/1994 | Willis et al. |
| 5,305,839 | A | 4/1994 | Kalsi et al. |
| 5,332,043 | A | 7/1994 | Ferguson |
| 5,340,182 | A | 8/1994 | Busink et al. |
| 5,351,767 | A | 10/1994 | Stogner et al. |
| 5,354,150 | A | 10/1994 | Canales |
| 5,368,113 | A | 11/1994 | Schulze-Beckinghausen |
| 5,386,746 | A | 2/1995 | Hauk |
| 5,388,651 | A | 2/1995 | Berry |
| 5,433,279 | A | 7/1995 | Tassari et al. |
| 5,461,905 | A | 10/1995 | Penisson |
| 5,497,840 | A | 3/1996 | Hudson |
| 5,501,280 | A | 3/1996 | Brisco |
| 5,501,286 | A | 3/1996 | Berry |
| 5,503,234 | A | 4/1996 | Clanton |
| 5,535,824 | A | 7/1996 | Hudson |
| 5,575,344 | A | 11/1996 | Wireman |
| 5,577,566 | A | 11/1996 | Albright et al. |
| 5,584,343 | A | 12/1996 | Coone |
| 5,588,916 | A | 12/1996 | Moore |
| 5,645,131 | A | 7/1997 | Trevisani |
| 5,661,888 | A | 9/1997 | Hanslik |
| 5,667,026 | A | 9/1997 | Lorenz et al. |
| 5,706,894 | A | 1/1998 | Hawkins, III |
| 5,711,382 | A | 1/1998 | Hansen et al. |
| 5,735,348 | A | 4/1998 | Hawkins, III |
| 5,735,351 | A | 4/1998 | Helms |
| 5,746,276 | A | 5/1998 | Stuart |
| 5,765,638 | A | 6/1998 | Taylor |
| 5,772,514 | A | 6/1998 | Moore |
| 5,785,132 | A | 7/1998 | Richardson et al. |
| 5,791,410 | A | 8/1998 | Castille et al. |
| 5,803,191 | A | 9/1998 | Mackintosh |
| 5,833,002 | A | 11/1998 | Holcombe |
| 5,836,395 | A | 11/1998 | Budde |
| 5,839,330 | A | 11/1998 | Stokka |
| 5,842,530 | A | 12/1998 | Smith et al. |
| 5,850,877 | A | 12/1998 | Albright et al. |
| 5,890,549 | A | 4/1999 | Sprehe |
| 5,909,768 | A | 6/1999 | Castille et al. |
| 5,931,231 | A | 8/1999 | Mock |
| 5,960,881 | A | 10/1999 | Allamon et al. |
| 5,971,079 | A | 10/1999 | Mullins |
| 5,971,086 | A | 10/1999 | Bee et al. |
| 6,000,472 | A | 12/1999 | Albright et al. |
| 6,012,529 | A | 1/2000 | Mikolajczyk et al. |
| 6,056,060 | A | 5/2000 | Abrahamsen et al. |
| 6,065,550 | A | 5/2000 | Gardes |
| 6,070,500 | A | 6/2000 | Dlask et al. |
| 6,079,509 | A | 6/2000 | Bee et al. |
| 6,119,772 | A | 9/2000 | Pruet |
| 6,142,545 | A | 11/2000 | Penman et al. |
| 6,161,617 | A | 12/2000 | Gjedebo |
| 6,170,573 | B1 | 1/2001 | Brunet et al. |
| 6,173,777 | B1 | 1/2001 | Mullins |
| 6,199,641 | B1 | 3/2001 | Downie et al. |
| 6,202,764 | B1 | 3/2001 | Ables et al. |
| 6,217,258 | B1 | 4/2001 | Yamamoto et al. |
| 6,227,587 | B1 | 5/2001 | Terral |
| 6,237,684 | B1 | 5/2001 | Bouligny, Jr. et al. |
| 6,276,450 | B1 | 8/2001 | Seneviratne |
| 6,279,654 | B1 | 8/2001 | Mosing et al. |
| 6,309,002 | B1 | 10/2001 | Bouligny |
| 6,311,792 | B1 | 11/2001 | Scott et al. |
| 6,315,051 | B1 | 11/2001 | Ayling |
| 6,334,376 | B1 | 1/2002 | Torres |
| 6,349,764 | B1 | 2/2002 | Adams et al. |
| 6,360,633 | B2 | 3/2002 | Pietras |
| 6,378,630 | B1 | 4/2002 | Ritorto et al. |
| 6,390,190 | B2 | 5/2002 | Mullins |
| 6,412,554 | B1 | 7/2002 | Allen et al. |
| 6,431,626 | B1 | 8/2002 | Bouligny |
| 6,443,241 | B1 | 9/2002 | Juhasz et al. |
| 6,527,047 | B1 | 3/2003 | Pietras |
| 6,527,493 | B1 | 3/2003 | Kamphorst et al. |
| 6,538,520 | B1 | 3/2003 | Merrill et al. |
| 6,553,825 | B1 | 4/2003 | Boyd |
| 6,591,471 | B1 | 7/2003 | Hollingsworth et al. |
| 6,595,288 | B2 | 7/2003 | Mosing et al. |
| 6,622,796 | B1 | 9/2003 | Pietras |
| 6,637,526 | B2 | 10/2003 | Juhasz et al. |
| 6,651,737 | B2 | 11/2003 | Bouligny |
| 6,668,684 | B2 | 12/2003 | Allen et al. |
| 6,679,333 | B2 | 1/2004 | York et al. |
| 6,688,394 | B1 | 2/2004 | Ayling |
| 6,688,398 | B2 | 2/2004 | Pietras |
| 6,691,801 | B2 | 2/2004 | Juhasz et al. |
| 6,725,938 | B1 | 4/2004 | Pietras |
| 6,732,822 | B2 | 5/2004 | Slack et al. |
| 6,742,584 | B1 | 6/2004 | Appleton |
| 6,742,596 | B2 | 6/2004 | Haugen |
| 6,832,656 | B2 | 12/2004 | Fournier, Jr. et al. |
| 6,832,658 | B2 | 12/2004 | Keast |
| 6,840,322 | B2 | 1/2005 | Haynes |
| 6,892,835 | B2 | 5/2005 | Shahin et al. |
| 6,907,934 | B2 | 6/2005 | Kauffman et al. |
| 7,073,602 | B2 * | 7/2006 | Simpson et al. ..... 166/385 |
| 7,096,977 | B2 | 8/2006 | Juhasz et al. |
| 7,100,698 | B2 | 9/2006 | Kracik et al. |
| 2001/0042625 | A1 * | 11/2001 | Appleton ..... 166/379 |
| 2002/0029878 | A1 | 3/2002 | Victor |
| 2002/0108748 | A1 | 8/2002 | Keyes |
| 2002/0134555 | A1 * | 9/2002 | Allen et al. ..... 166/377 |
| 2002/0170720 | A1 | 11/2002 | Haugen |
| 2003/0155159 | A1 | 8/2003 | Slack et al. |
| 2003/0164276 | A1 | 9/2003 | Snider et al. |
| 2003/0173073 | A1 | 9/2003 | Snider et al. |
| 2003/0221519 | A1 | 12/2003 | Haugen et al. |
| 2004/0003490 | A1 | 1/2004 | Shahin et al. |
| 2004/0069500 | A1 | 4/2004 | Haugen |
| 2004/0144547 | A1 | 7/2004 | Koithan et al. |
| 2004/0173358 | A1 | 9/2004 | Haugen |
| 2004/0216924 | A1 | 11/2004 | Pietras et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 469 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |

| | | |
|---|---|---|
| GB | 2 345 074 | 6/2000 |
| GB | 2 357 530 | 8/2001 |
| JP | 2001/173349 | 6/2001 |
| WO | WO 90-06418 | 6/1990 |
| WO | WO 92-18743 | 10/1992 |
| WO | WO 93-07358 | 4/1993 |
| WO | WO 95-10888 | 4/1995 |
| WO | WO 96-18799 | 6/1996 |
| WO | WO 97-08418 | 3/1997 |
| WO | WO 98-05844 | 2/1998 |
| WO | WO 98-11322 | 3/1998 |
| WO | WO 98-32948 | 7/1998 |
| WO | WO 99-11902 | 3/1999 |
| WO | WO 99-41485 | 8/1999 |
| WO | WO 99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01/33033 | 5/2001 |
| WO | WO 01-94738 | 12/2001 |
| WO | WO 2004-022903 | 3/2004 |

OTHER PUBLICATIONS

"First Success with Casing-Drilling" Word Oil, Feb. 1999, pp. 25.
Laurent, et al., "A New Generation Drilling Rig: Hydraulically Powered And Computer Controlled, " CADE/CAODC Paper 99-120, CADE/CAODC Spring Drilling Conference, Apr. 7 & 8, 1999, 14 pages.
Laurent et al., "Hydraulic Rig Supports Casing Drilling," World Oil, Sep. 1999, pp. 61-68.
Shepard, et al., "Casing Drilling: An Emerging Technology," IADC/SPE Paper 67731, SPE/IADC Drilling Conference, Feb. 27-Mar. 1, 2001, pp. 1-13.
Warren, et al., "Casing Drilling Technology Moves To More Challenging Application," AADE Paper 01-NC-HO-32, AADE National Drilling Conference, Mar. 27-29, 2001, pp. 1-10.
Fontenot, et al.. "New Rig Design Enhances Casing Drilling Operations In Lobo Trend," paper WOCD-0306-04, World Oil Casing Drilling Technical Conference, Mar. 6-7, 2003, pp. 1-13.
Vincent, et al., "Liner And Casing Drilling—Case Histories And Technology," Paper WOCD-0307-02, World Oil Casing Drilling Technical Conference. Mar. 6-7, 2003, pp. 1-20.
Tessari, et al., "Retrievable Tools Provide Flexibility for Casing Drilling," Paper No. WOCD-0306-01, World Oil Casing Drilling Technical Conference, 2003, pp. 1-11.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Coiled Tubing Handbook, World Oil, Gulf Publishing Company, 1993.
Bickford L Dennis and Mark J. Mabile, Casing Drilling Rig Selection For Stratton Field, Texas, World Oil, vol. 226, No. 3, Mar. 2005.
G H. Kamphorst, G. L. Van Wechem, W. Boom, D. Bottger, and K. Koch, Casing Running Tool, SPE/IADC 52770.
Norwegian Office Action for Application No. 2005 3549 dated Sep. 27, 2009.

* cited by examiner

CASING FEEDER

CROSS-REFERENCE TO RELATED APPLICATIONS

This application claims benefit of U.S. Provisional Patent Application Ser. No. 60/589,495, filed on Jul. 20, 2004, which application is herein incorporated by reference in its entirety.

BACKGROUND OF THE INVENTION

1. Field of the Invention

The present invention relates to methods and apparatus for drilling with top drive systems. Particularly, the invention relates to methods and apparatus for adapting a top drive for use with running casing. More particularly still, the invention relates to a top drive system having a torque head and a casing feeder adapted to feed the casing into the torque head.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, one conventional method to complete a well includes drilling to a first designated depth with a drill bit on a drill string. Then, the drill string is removed and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to is set the casing into the wellbore. In this manner, wells are typically formed with two or more strings of casing of an ever-decreasing diameter.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Another method of performing well completion operations involves drilling with casing, as opposed to the first method of drilling and then setting the casing. In this method, the casing string is run into the wellbore along with a drill bit for drilling the subsequent, smaller diameter hole located in the interior of the existing casing string. The drill bit is operated by rotation of the drill string from the surface of the wellbore. Once the borehole is formed, the attached casing string may be cemented in the borehole. The drill bit is either removed or destroyed by the drilling of a subsequent borehole. The subsequent borehole may be drilled by a second working string comprising a second drill bit disposed at the end of a second casing that is of sufficient size to line the wall of the borehole formed. The second drill bit should be smaller than the first drill bit so that it fits within the existing casing string. In this respect, this method requires at least one run-in into the wellbore per casing string that is set into the wellbore.

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

In order to drill with casing, most existing top drives require a threaded crossover adapter to connect to the casing. This is because the quill of the top drive is not sized to connect with the threads of the casing. The crossover adapter is design to alleviate this problem. Typically, one end of the crossover adapter is designed to connect with the quill, while the other end is designed to connect with the casing.

However, the process of threadedly connecting and disconnecting a casing is time consuming. For example, each time a new casing is added, the casing string must be disconnected from the crossover adapter. Thereafter, the crossover must be threaded into the new casing before the casing string may be run. Furthermore, this process also increases the likelihood of damage to the threads, thereby increasing the potential for downtime.

More recently, top drive adapters has been developed to facilitate the casing running process. Top drive adapters that grip the external portion of the casing are generally known as torque heads, while adapters that grip the internal portion of the casing are generally known as spears. An exemplary torque head is disclosed in U.S. patent application Ser. No. 10/850,347, entitled Casing Running Head, which application was filed on May 20, 2004 by the same inventor of the present application. An exemplary spear is disclosed in U.S. patent application Publication No. 2005/0051343, by Pietras, et. al. These applications are assigned to the assignee of the present application and are herein incorporated by reference in their entirety.

One of the challenges of running casing using a top drive adapter is positioning the casing for engagement with the top drive adapter. To engage the casing, the top drive adapter must be lowered relative to the casing, or the casing must be raised relative to the top drive adapter.

There is a need, therefore, for methods and apparatus for positioning a casing for handling by a top drive adapter during casing running operations. There is a further need for methods and apparatus for running casing with a top drive in an efficient manner.

SUMMARY OF THE INVENTION

The present invention generally relates to a method and apparatus for drilling with a top drive system. Particularly, the present invention relates to methods and apparatus for handling tubulars using a top drive system.

In one embodiment, a tubular gripping member for use with a top drive to handle a tubular comprises a housing operatively connected to the top drive and a plurality of gripping elements radially disposed in the housing for engaging the tubular, wherein moving the housing relative the plurality of gripping elements causes the plurality of gripping members to engage the tubular.

In another embodiment, a method for handling a tubular using a top drive is provided. The method includes providing a first tubular gripping member and a second tubular member coupled to a top drive; retaining the tubular with the second gripping member; moving the tubular into engagement with the first gripping member; and rotating the tubular using the top drive.

In another embodiment, a method of handling a tubular comprises providing a top drive operatively connected to a gripping head. The gripping head has a housing, a plurality of gripping elements radially disposed in the housing for engaging the tubular, and a plurality of engagement members movably disposed on each of the plurality of gripping elements. The method further includes disposing the tubular within the plurality of gripping elements, moving the housing relative to the plurality of gripping elements, engaging the tubular, and pivoting the plurality of engagement members.

In another embodiment, a tubular conveying apparatus for use with a top drive to handle a tubular is provided. The apparatus includes a pair of conveying members having a retaining member for engaging the tubular, the conveying members actuatable to engage the tubular between the retaining member of each conveying member. The apparatus also includes a driving member for energizing the retaining member, thereby conveying the tubular relative to the conveying apparatus.

In another embodiment, a casing feeder is provided to position a casing for engagement with a tubular gripping member. The casing feeder includes a pair of conveying arms for engagement with the casing. Each conveying arm may be raised or lowered by a cylinder. The conveying arms are equipped with a motor driven roller for engaging and lifting the casing. The casing feeder may also be equipped with a counting apparatus to determine the positioning of the casing in the torque head.

In another embodiment, a tubular conveying apparatus is provided for use with a top drive to handle a tubular. The tubular conveying apparatus includes a pair of arms having a roller for engaging the tubular, the arms actuatable to engage the tubular between the roller of each arm. The conveying apparatus also includes a motor for rotating the roller, thereby conveying the tubular relative to the conveying apparatus.

In yet another embodiment, the conveying apparatus further comprises a counting apparatus. The counting apparatus may include a sensor for activating a counter. The counting apparatus may further include a counting member for determining a position of the tubular.

In another embodiment, a method of conveying a tubular includes providing a plurality of lever members, each of the lever members having a retaining member; disposing the tubular between the retaining members; engaging the tubular with the retaining members; and rotating the retaining members to axially convey the tubular.

In another embodiment, a top drive system for handling a tubular includes a top drive; a tubular gripping member coupled to the top drive, the tubular gripping member capable of gripping the tubular and transferring torque from the top drive; and a tubular conveying member operatively coupled to the top drive, the tubular conveying member adapted to position the tubular for engagement with the tubular gripping member.

BRIEF DESCRIPTION OF THE DRAWINGS

So that the manner in which the above recited features and other features contemplated and claimed herein are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In one embodiment, a top drive system for drilling includes a top drive adapter for gripping and rotating the casing. In another embodiment, a casing feeder is provided for positioning a casing for handling by the top drive adapter.

The casing feeder includes a pair of conveying members for engagement with the casing. The conveying member includes a conveying arm and a motor driven roller for engaging and lifting the casing. The conveying arms may be raised or lowered by a cylinder to engage the roller with the casing. Activation of the rollers moves the casing relative to the casing feeder. The casing feeder may also be equipped with a counting apparatus to determine the positioning of the casing in the torque head.

Figure 1A:
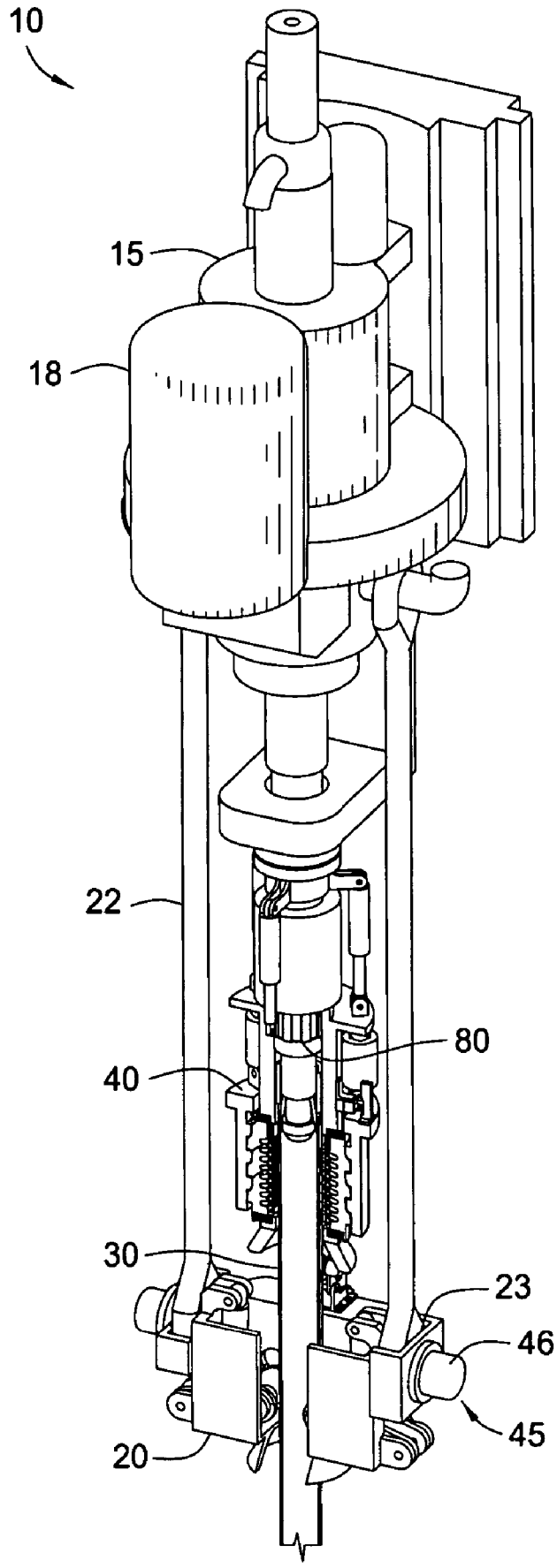
FIGS. 1A-1B show an exemplary embodiment of a top drive system.
Figure 1B:
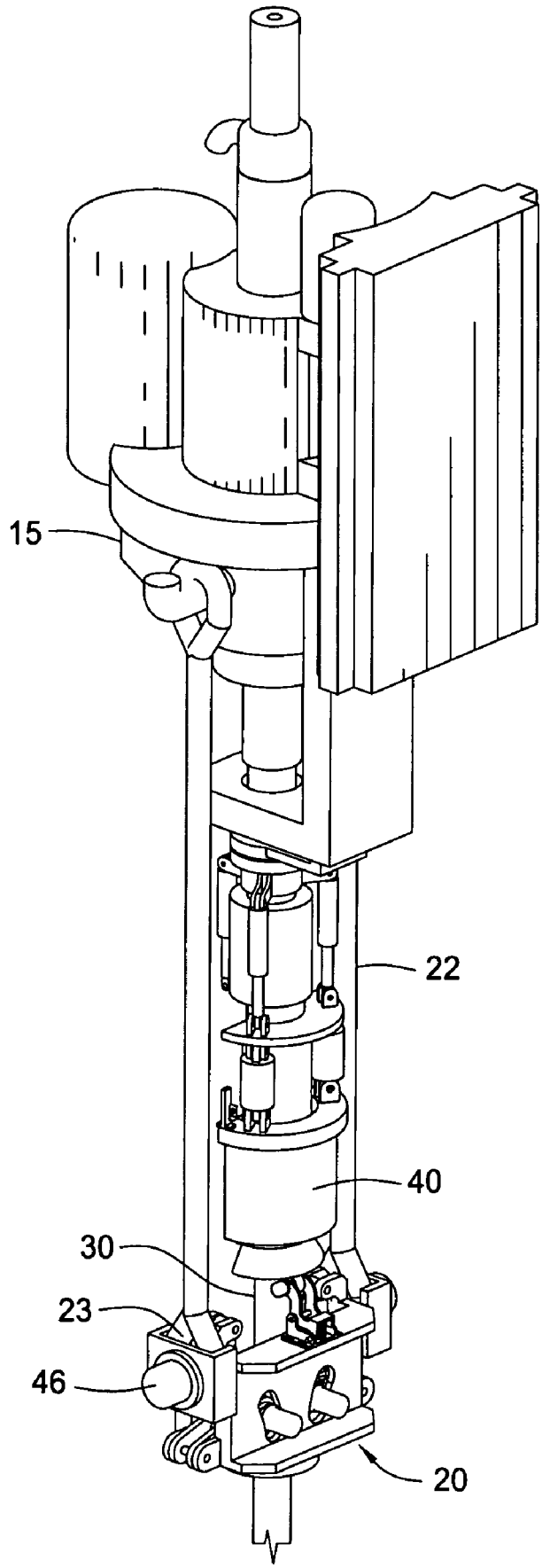

FIGS. 1A-1B show a top drive system 10 applicable to drilling with casing operations or a wellbore operation that involves picking up/laying down tubulars. The top drive system 10 may be suspended by a traveling block above the surface of a well. Generally, the top drive 15 includes a motor 18 which is used to rotate a casing 30 at various stages of the operation, such as during drilling with casing or while making up or breaking out a connection between the casings. A railing system (not shown) is coupled to the top drive 15 to guide the axial movement of the top drive 15 and to prevent the top drive 15 from rotational movement during rotation of the casings. As used herein, each casing 30 may include a single casing or a casing string having more than one casing. Furthermore, it must be noted that aspects of the present invention are equally applicable to other types of wellbore tubulars, such as drill pipe.

As shown in FIGS. 1A-1B, the top drive system 10 includes a top drive adapter and a casing feeder to facilitate the casing running operation. In the preferred embodiment, the top drive adapter is a torque head 40. The torque head 40 may be utilized to grip an upper portion of the casing 30 and impart torque from the top drive to the casing 30. The torque head 40 may be coupled to the casing feeder 20 using one or more bails 22. The casing feeder 20 may be utilized to position the casing 30 for engagement with the torque head 40. It must be noted that the top drive adapter may be a spear or other gripping apparatus suitable for gripping the casing.

Casing Running Head

Figure 2:
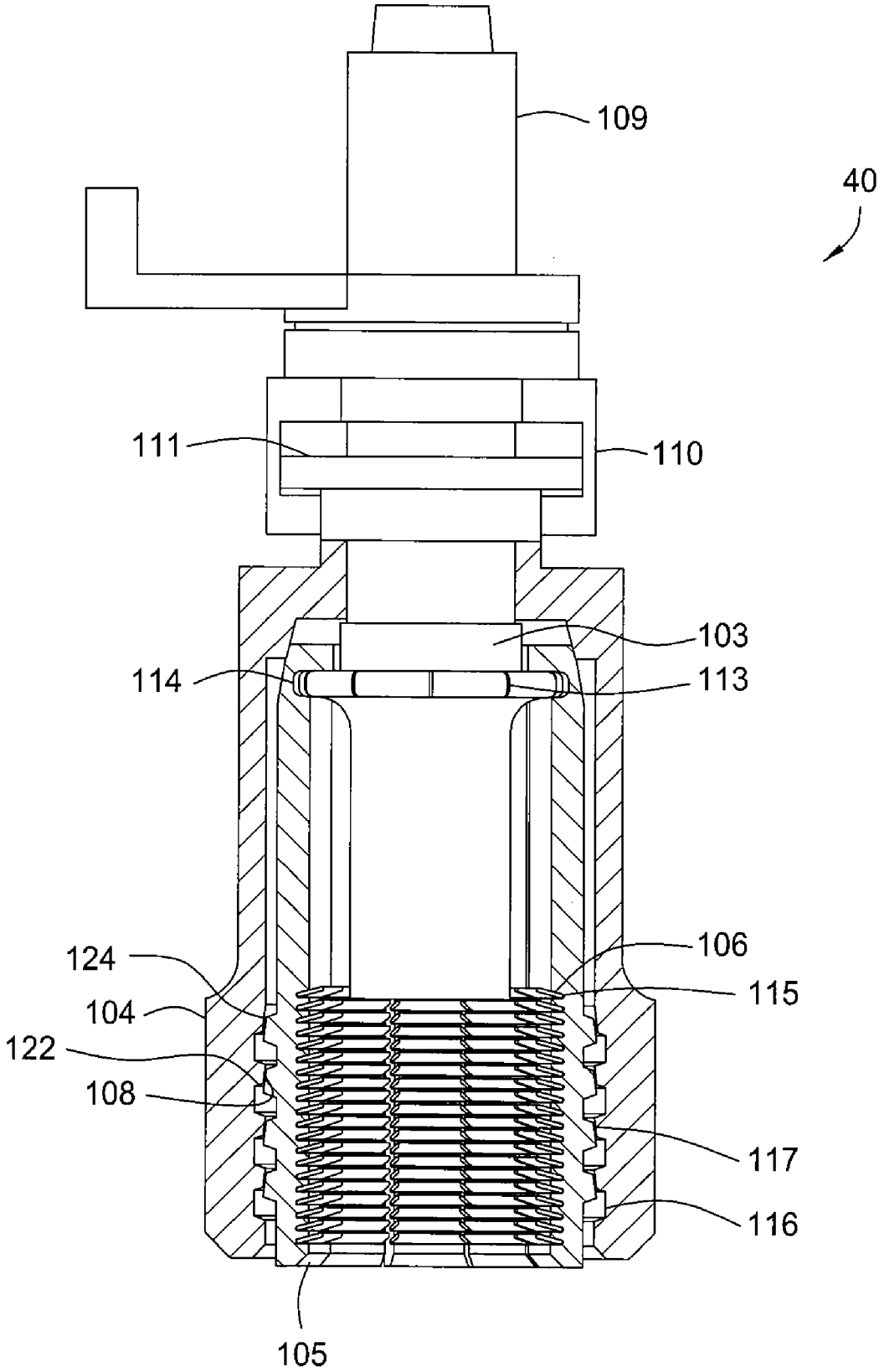
FIG. 2 shows an exemplary torque head for use with the top drive system. As shown, the torque head is in a partially actuated position.

FIG. 2 illustrates a cross-sectional view of an exemplary torque head 40 suitable for use with the top drive system. The torque head 40 includes a mandrel 103 coupled to a rotary unit 109 for connection to the top drive 15. In this respect, the top drive 15 may rotate, raise, or lower the torque head 40 for drilling with casing. The mandrel 103 includes a load collar 113 for coupling one or more gripping elements 105 to the mandrel 103. As shown in FIG. 2, an upper portion of the gripping element 105 includes a recess 114 for engagement with the load collar 113 of the mandrel 103. The gripping elements 105 are circumferentially disposed around the mandrel 103.

A housing 104 surrounds the gripping elements 105 and ensures the gripping elements 105 remain coupled to the mandrel 103. The housing 104 is actuatable by a hydraulic cylinder 110 disposed on the mandrel 103. Particularly, an upper portion of the housing 104 is coupled to the piston 111 of the hydraulic cylinder 110. Actuation of the piston 111 causes the housing 104 to move axially relative to the mandrel 103.

Figure 3:
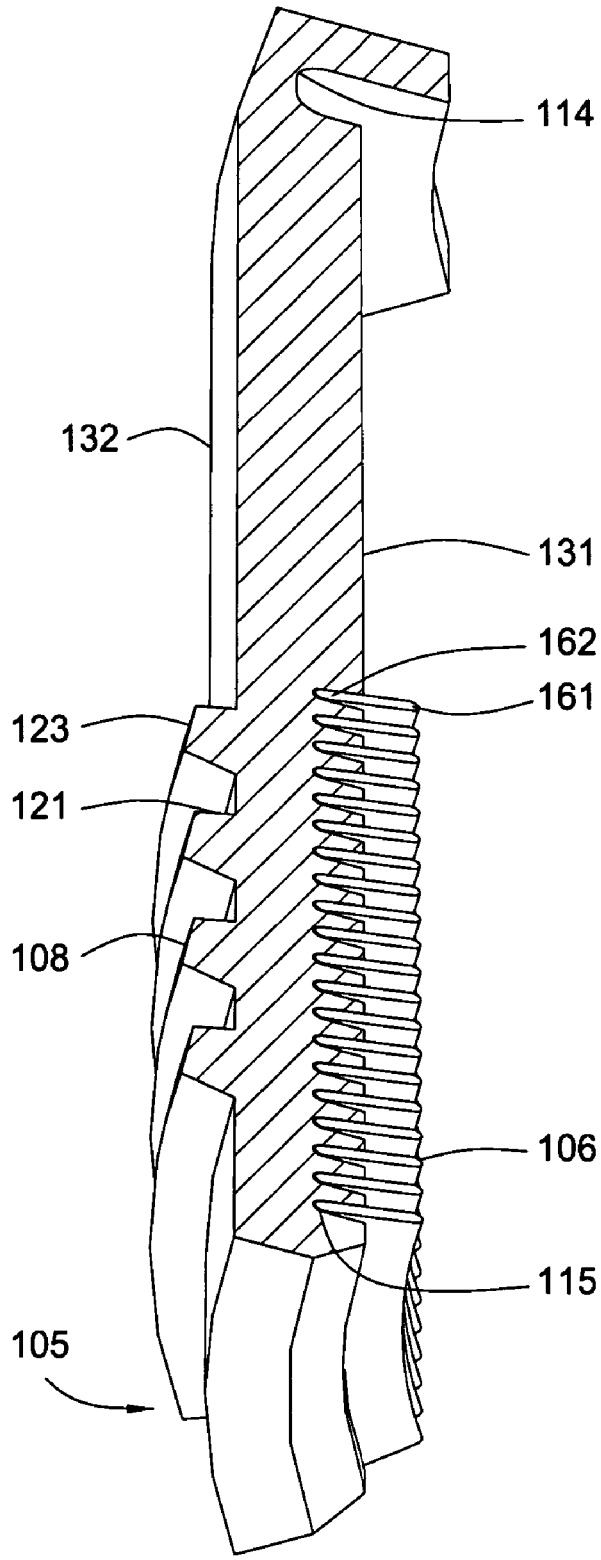
FIG. 3 is a perspective view of the gripping element of the torque head of FIG. 2.
Figure 4:
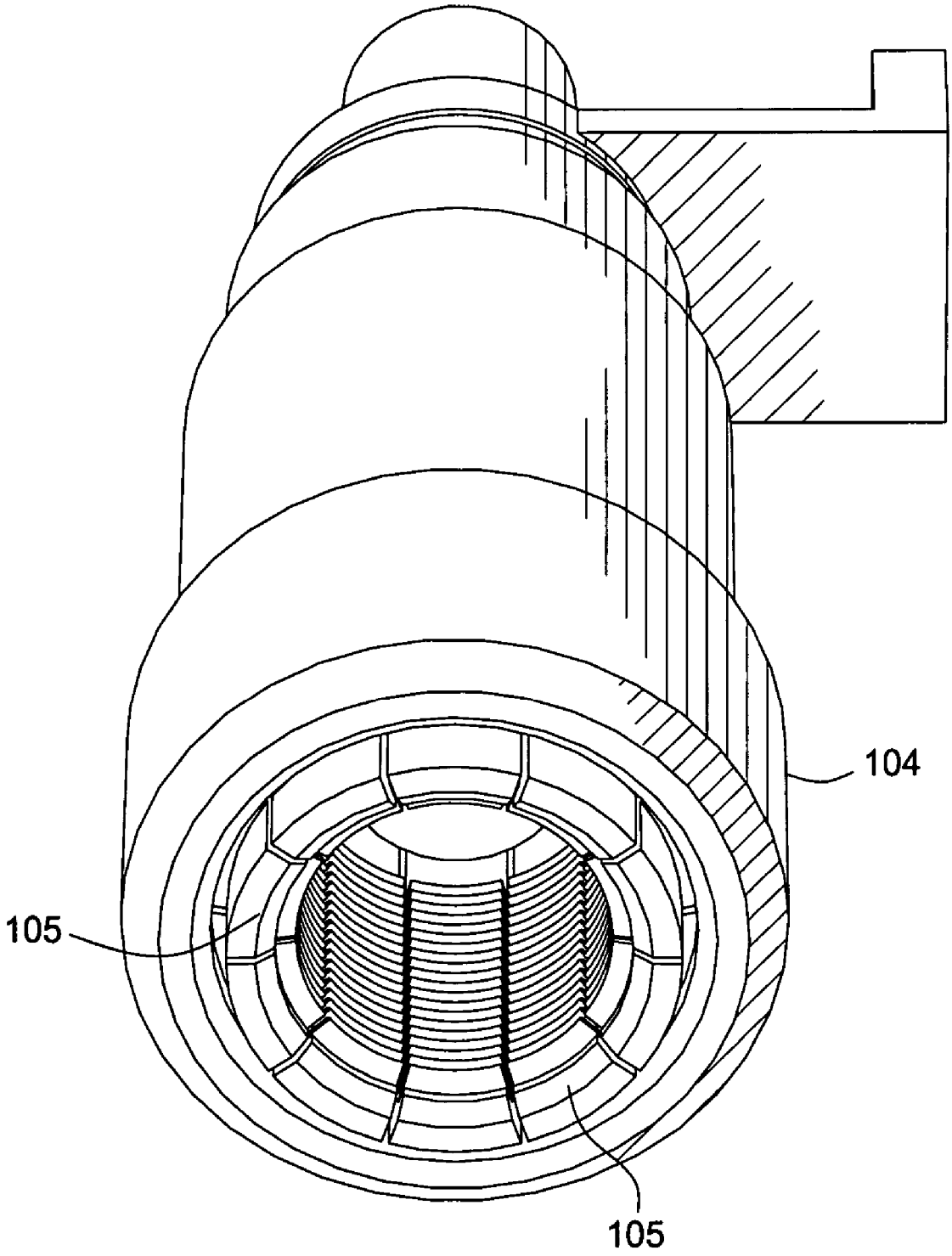
FIG. 4 is a perspective view of the torque head of FIG. 2.

The gripping elements 105 are adapted to engage and retain the casing 30 once the casing 30 is inserted into the housing 104. As shown in FIG. 3, the gripping elements 105 include an upper end having a recess 114 for coupling to the mandrel 103 and a lower end having one or more engagement members 106. A width of the gripping elements 105 may be arcuate in shape such that the gripping elements 105 may be circumferentially disposed to form a substantially tubular structure to engage a tubular such as a casing or a pipe. FIG. 4 is a perspective view of the torque head 40 showing the gripping elements 105 circumferentially disposed inside the housing 104.

Referring again to FIG. 3, the gripping elements 105 include an arcuate interior surface 131 for engaging the tubular and an arcuate exterior surface 132 for engaging the housing 104. In one embodiment, the interior surface 131 includes one or more slots 115 for receiving one or more engagement members 106. Preferably, the engagement members 106 are pivotable within the slots 115. Initially, the engagement members 106 are disposed at an upward angle in a direction towards the upper portion of the mandrel 103. In other words, the distal end 161 of the engagement members 106 is higher than the proximal end 162. More preferably, each engagement member 106 is set at the same angle. When the engagement members 106 engage the casing string, the load of the casing string will cause the engagement members 106 to pivot in the slots 115 thereby carrying the casing string load. It is believed that this arrangement allows the engagement members 106 to carry an equal, partial load of the casing 30. The engagement members 106 may be designed with any suitable contact surface as is known to a person of ordinary skill in the art. For example, the contact surface may be a smooth surface or a tooth structure to increase the load carrying capacity.

Figure 5:
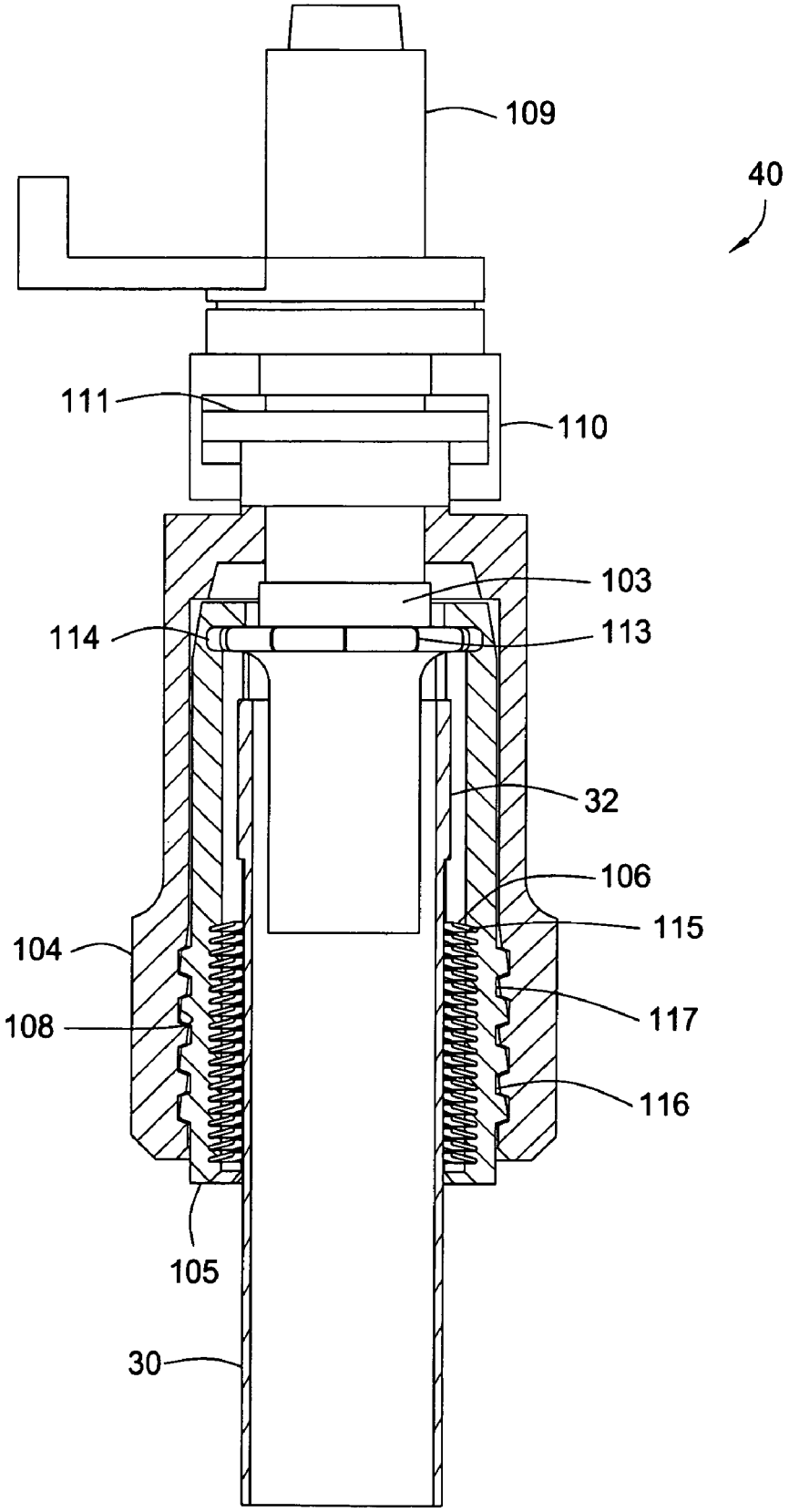
FIG. 5 shows the torque head of FIG. 2 in an unactuated position.

The exterior surface 132 of the gripping elements 105 is adapted to interface with the interior surface of the housing 104 to move the gripping elements 105 radially relative to the housing 104. In one embodiment, the gripping elements 105 may interface with the housing 104 using a complementary key and groove system. As shown in FIGS. 3 and 4, the lower, exterior portion of the gripping elements 105 includes one or more keys 108 formed thereon. The keys 108 are adapted to fit in a complementary groove 116 formed on the inner surface of the housing 104 when the torque head 40 is in the unactuated or "unlocked" position, as illustrated in FIG. 5. Referring to FIG. 2, the housing 104 includes one or more keys 117 formed between the grooves 116. The keys 117 of the housing 104 reside between the keys 108 of the gripping elements 105 when the torque head 40 is in the unlocked position.

In one aspect, the housing 104 may be actuated to move the keys 108 of the housing 104 and the keys 1 17 of the gripping element 105 into an actuated or locking position. FIG. 2 shows the keys 108, 117 in a partially locked position. To this end, the keys 108 of the gripping elements 105 include an upper surface 121 and an abutment surface 123. The upper surface 121 of the keys 108 may be inclined downward to facilitate the movement of the keys 108 of the gripping elements 105 out of the grooves 116 of the housing 104. Similarly, the keys 117 of the housing 104 include a lower surface 122 and an abutment surface 124. The lower surface 122 is adapted to engage the upper surface of the key 108 of the gripping element 105 as the housing 104 is lowered. Due the incline of the upper surface 121, the gripping elements 105 move radially inward to engage the casing 30 while the housing 104 is lowered.

The abutment surfaces 123, 124 are adapted to provide a self locking function. In one embodiment, the abutment surface 123 of the gripping elements 105 is inclined slightly downward, and the abutment surface 124 of the housing 104 has a complementary incline. When the two abutment surfaces 123, 124 engage, the incline causes the gripping elements 105 to move radially toward the axial center to establish its grip on the casing 30. Preferably, the abutment surface 122 of the gripping elements 105 is angled at about ten degrees or less relative to a vertical axis. More preferably, the abutment surface 122 of the gripping elements 105 is inclined at about seven degrees or less relative to a vertical axis.

In operation, as the casing 30 is inserted into the torque head 40, the coupling 32 of the casing 30 forces the gripping elements 105 to expand radially. In this respect, the keys 108 of the gripping elements 105 move into the grooves 116 of the housing 104 to facilitate entrance of the casing 30. FIG. 5 shows the casing 30 inserted into the torque head 40. It can be seen that coupling 32 is located above the gripping elements 105.

Figure 6:
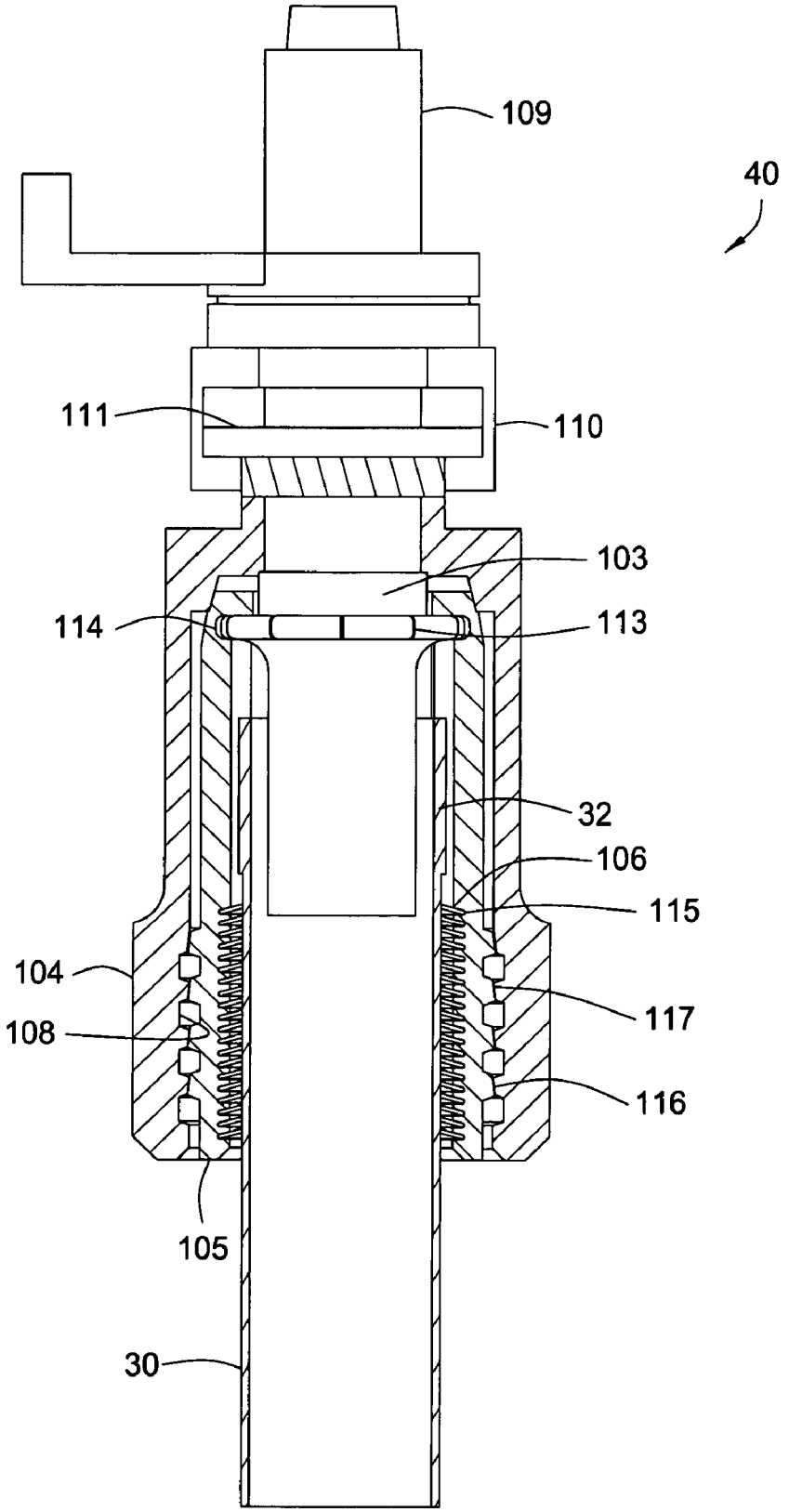
FIG. 6 shows the torque head of FIG. 2 in an actuated position.

To grip the casing 30, the hydraulic cylinder 110 is actuated to move the piston 111 downward. In turn, the housing 104 is lowered relative to the gripping elements 105. Initially, the lower surface 122 of the housing 104 encounters the upper surface 121 of the gripping elements 105. The incline of the upper and lower surfaces 121, 122 facilitate the movement of the gripping elements 105 out of the groove 116 and the lowering of the housing 104. Additionally, the incline also causes the gripping elements 105 to move radially to apply a gripping force on the casing 30. As shown in FIG. 2, the housing 104 has been lowered relative to the gripping elements 105. Additionally, the keys 108 of the gripping elements 105 have moved out of the groove 116. The housing 104 is lowered until the abutment surfaces 123, 124 of the keys 108, 117 substantially engage each other, as shown in FIG. 6. It can be seen in FIG. 6 that the piston 111 is fully actuated.

During drilling operation, the casing string load will pull the casing 30 down. Due to this movement, the engagement members 106 will pivot in the slot 115 of the gripping elements 105 to clamp the casing 30. In this respect, the engagement members 106 will work as an axial free running drive. Moreover, because the engagement members 106 are all set the same angle, each of the engagement members 106 carries an equal amount of the casing string weight. Additionally, the radial clamping force will be balanced by the housing 104. In one embodiment, when the key angle between the key 117 of the housing 104 and the key 108 of the gripping element 105 is less than seven degrees, the radial force will be distributed across the housing 104.

When the casing string load is removed, such as actuating the spider to retain the casing string, the engagement members 106 will immediately release the radial force exerted on the casing 30. Thereafter, the piston is deactuated to raise the housing 104 relative to the gripping elements 105. The casing 30 may be removed when the keys 108 of the gripping elements 105 return to their respective grooves 116.

In another aspect, the torque head 40 may be used to transfer torque. In this respect, an appropriate hydraulic cylinder may be selected to apply a sufficient force to clamp the casing 30.

Figure 7:
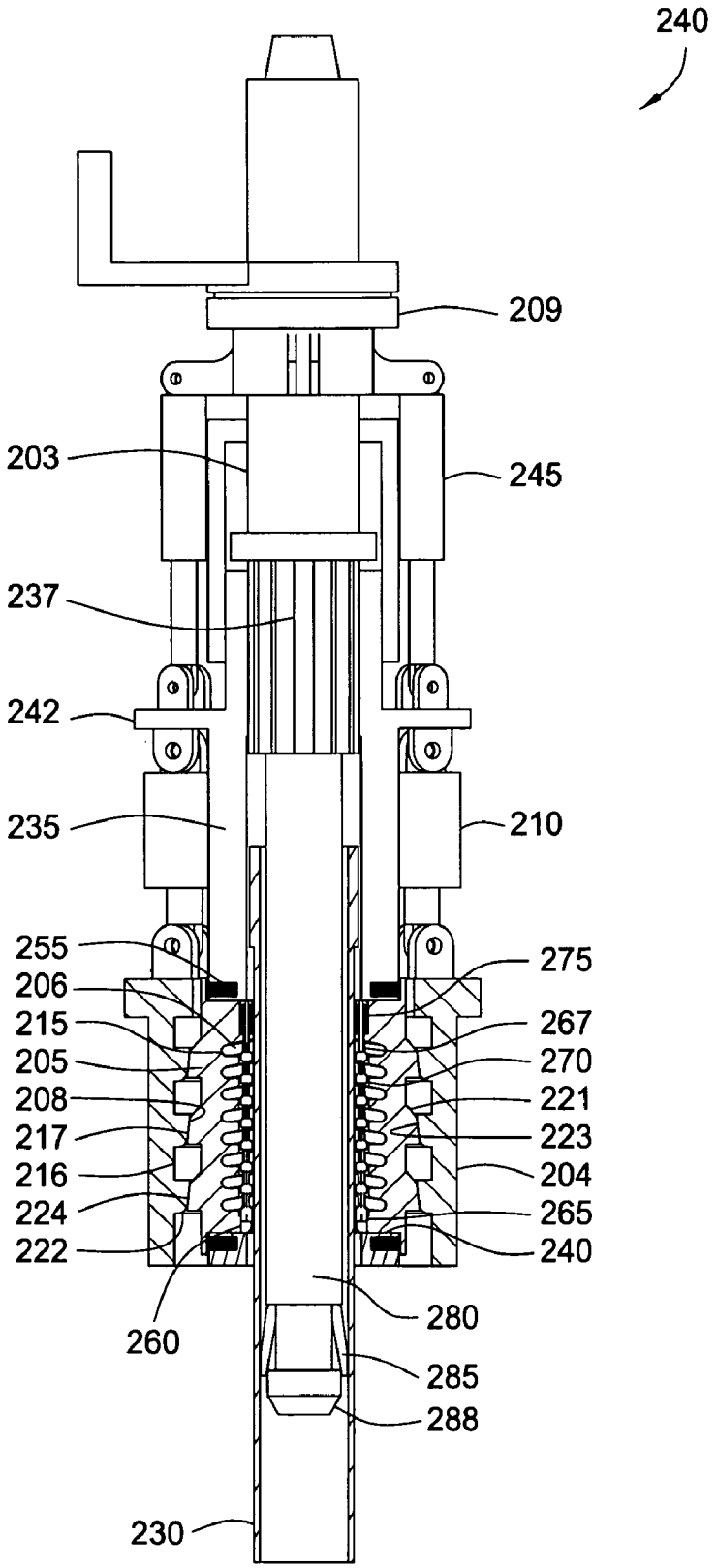
FIG. 7 shows another embodiment of a torque head.

FIG. 7 presents another embodiment of a torque head 240. The torque head 240 includes a rotary unit 209 for connection with the top drive 15 and transmitting torque. A mandrel 203 extends below the rotary unit 209 and is coupled to an upper end of a tubular body 235 using a spline and groove connection 237. The spline and groove connection 237 allows the body 235 to move axially relative to the mandrel 203 while still allowing torque to be transmitted to rotate the body 235. The lower portion of the body 235 includes one or more windows 240 form through a wall of the body 235. The windows 240 are adapted to contain a gripping element 205. Preferably, eight windows 240 are formed to contain eight gripping elements 205.

The outer surface of the body 235 includes a flange 242. One or more compensating cylinders 245 connect the flange 242 to the rotary unit. In this respect, the compensating cylinders 245 control the axial movement of the body 235. The compensating cylinder 245 is particularly useful during makeup or breakout of tubulars. For example, the compensating cylinder 245 may allow the body 235 to move axially to accommodate the change in axial distance between the tubulars as the threads are made. An exemplary compensating cylinder is a piston and cylinder assembly. The piston and cylinder assembly may be actuated hydraulically, pneumatically, or by any other manner known to a person of ordinary skill in the art. A suitable alternate compensating cylinder is disclosed in U.S. Pat. No. 6,056,060, which patent is herein incorporated by reference in its entirety and is assigned to the same assignee of the present invention.

A housing 204 is disposed around the windows 240 of the body 235. The housing 204 is coupled to the flange 242 using a one or more actuating cylinders 210. In this respect, the housing 204 may be raised or lowered relative to the body 235. The interior of the housing 204 includes a key and groove configuration for interfacing with the gripping element 205. In one embodiment, the key 217 includes an inclined abutment surface 224 and an inclined lower surface 222. Preferably, the transition between the lower surface 222 and the abutment surface 224 is curved to facilitate lowering of the housing 204 relative to the body 235.

A gripping element 205 is disposed in each of the windows 240 in the body 235. In one embodiment, the gripping element 205 has an exterior surface adapted to interface with the key and groove configuration of the housing 204, as shown in FIGS. 7 and 8. Particularly, keys 208 are formed on the exterior surface and between the keys 208 are grooves that may accommodate the key 217 of the housing 204. The keys 208 of the gripping element 205 include an upper surface 221 and an abutment surface 223. The upper surface 221 is inclined downward to facilitate movement of the keys 217 of the housing 204. The abutment surface 223 has an incline complementary to the abutment surface 224 of the housing 204. A collar 250 extends from the upper and lower ends of the exterior surface of the gripping elements 205. The collars 250 engage the outer surface of the body 235 to limit the inward radial movement of the gripping elements 205. Preferably, a biasing member 255 is disposed between the collar and the body 235 to bias the gripping element 205 away from the body 235. In one embodiment, the biasing member 255 may be a spring.

The interior surface of the gripping element 205 includes one or more engagement members 206. In one embodiment, each engagement member 206 is disposed in a slot 215 formed in the interior surface of the gripping element 205. Preferably, the engagement members 206 are pivotable in the slot 215. The portion of the engagement member 206 disposed in the interior of the slot 215 may be arcuate in shape to facilitate the pivoting motion. The tubular contact surface of the engagement members 257 may be smooth or rough, or have teeth formed thereon.

In another aspect, the gripping element 205 may include a retracting mechanism to control movement of the engagement members 206. In one embodiment, an axial bore 260 is formed adjacent the interior surface of the gripping element 205. An actuating rod 265 is disposed in the bore 260 and through a recess 267 of the engagement members 206. The actuating rod 265 includes one or more supports 270 having an outer diameter larger than the recess 267 of the engagement members 206. A support 270 is positioned on the actuating rod 265 at a level below each engagement member 206 such that the engagement members 206 rest on their respective support 270.

Figure 8A:
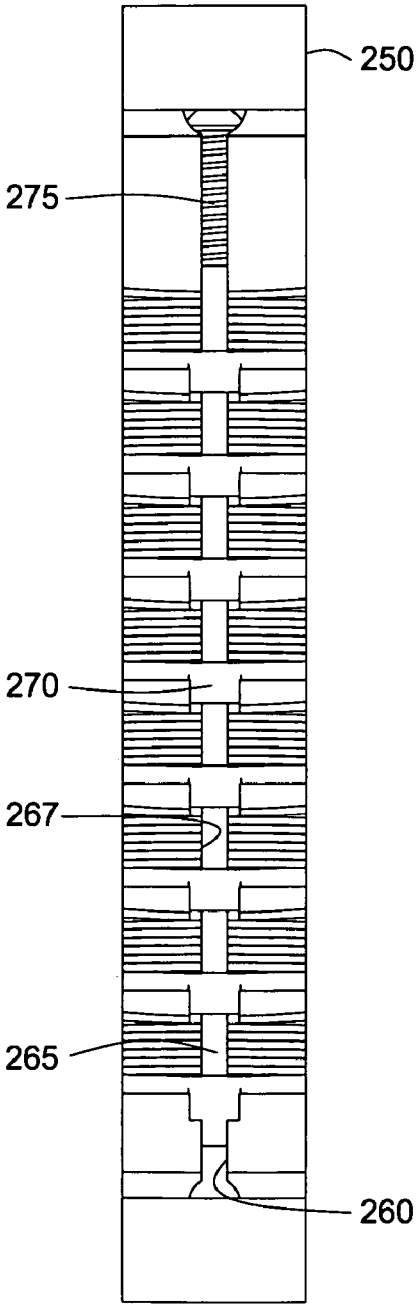
FIGS. 8A-B are two different views of an exemplary gripping element for use with the torque head of FIG. 7.
Figure 8B:
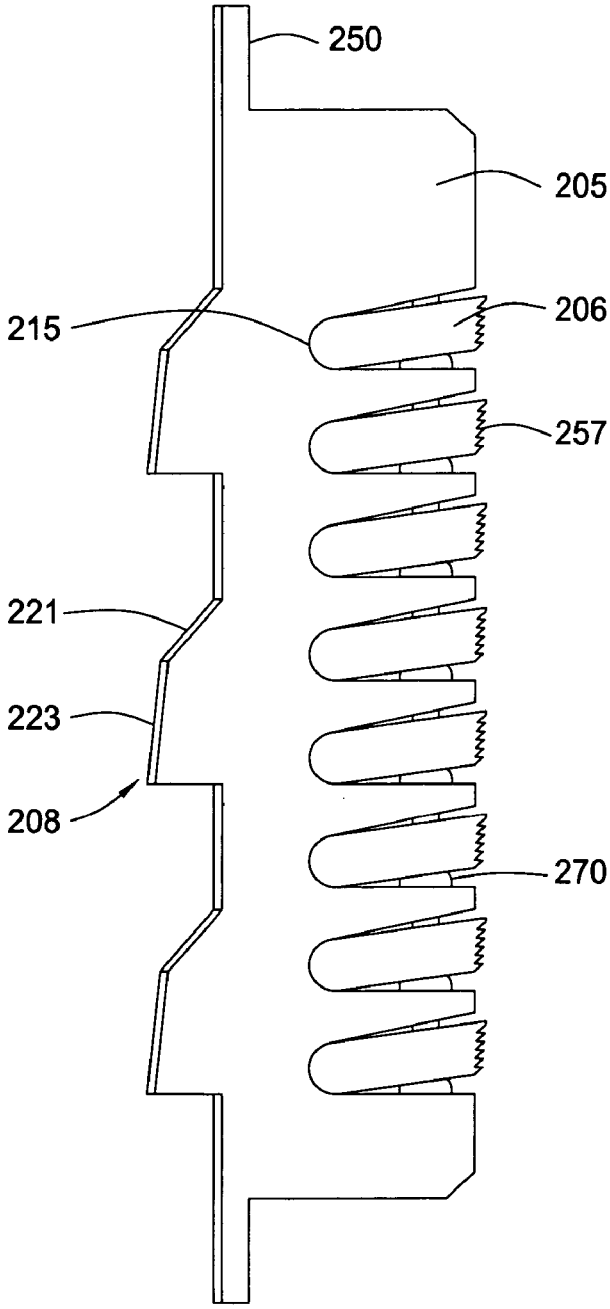

A biasing member 275 coupled to the actuating rod 265 is disposed at an upper end of the bore 260. In the relaxed position, the biasing member 275 biases the actuating rod 265 in the upward position. In this respect, the actuating rod 265 places the engagement members 206 in the retracted position, or pivoted upward position, as shown in FIGS. 8A-B. When the biasing member 275 is compressed, the actuating rod 265 is placed in the downward position. In this respect, the engagement members 206 are in the engaged position, or pivoted downward such that it is relatively closer to a horizontal axis than the retracted position.

In operation, the casing 230 is inserted into the body 235 of the torque head 240. At this point, the keys 208 of the gripping element 205 are disposed in their respective groove 216 in the housing 204. Additionally, the actuating rod 265 is in the upward position, thereby placing the engagement members 206 in the retracted position. As the casing 230 is inserted into the torque head 240, the coupling moves across the gripping elements 205 and forces the gripping elements 205 to move radially outward. After the coupling moves past the gripping elements 205, the biasing members 255 bias the gripping elements 205 to maintain engagement with the casing 30.

Once the casing 230 is received in the torque head 240, the actuating cylinder 210 is activated to lower the housing 204 relative to the body 235. Initially, the lower surface 222 of the housing 204 encounters the upper surface 221 of the gripping elements 205. The incline of the upper and lower surfaces 221, 222 facilitate the movement of the gripping elements 205 out of the groove 216 and the lowering of the housing 204. Additionally, the incline also causes the gripping elements 205 to move radially to apply a gripping force on the casing 30. Preferably, the gripping elements 205 move radially in a direction substantially perpendicular to the vertical axis of the casing 30. The housing 204 continues to be lowered until the abutment surfaces 223, 224 of the keys 208, 217 substantially engage each other, as shown in FIG. 7. During the movement of the housing 204, the biasing members 255 between the collars 250 and the body 235 are compressed. Additionally, the weight of the casing 30 may force the engagement members 205 to pivot slightly downward, which, in turn, causes the actuating rod 265 to compress the biasing member 275. In this respect, a radial clamping force is applied to support the axial load of the casing 30.

To makeup the casing 230 to the casing string, the top drive 15 may be operated to provide torque to rotate the casing 230 relative to the casing string. During makeup, the compensating cylinder 245 is activated to compensate for the change in axial distance as a result of the threaded engagement. In this respect, the body 235 is allowed to move axially relative to the mandrel 203 using the spline and groove connection 237.

During drilling operation, the entire casing string load is supported by the torque head 240. Particularly, the heavier casing string load further pivots the engagement members 206 in the slot 215 of the gripping elements 205. In this respect, the casing string load is distributed among the engagement members 206, thereby allowing the torque head 240 to work as an axial free running drive. Moreover, because the engagement members 206 are all set the same angle, each of the engagement members 206 carries an equal amount of the casing string weight. Additionally, the radial clamping force will be balanced by the housing 204. In one embodiment, when the angle between the key 217 of the housing 204 and the key 208 of the gripping element 205 is less than seven degrees, the radial force will be distributed across the housing 204. In this manner, the torque head may be used to connect tubulars and generally used to perform tubular handling operations.

Figure 9:
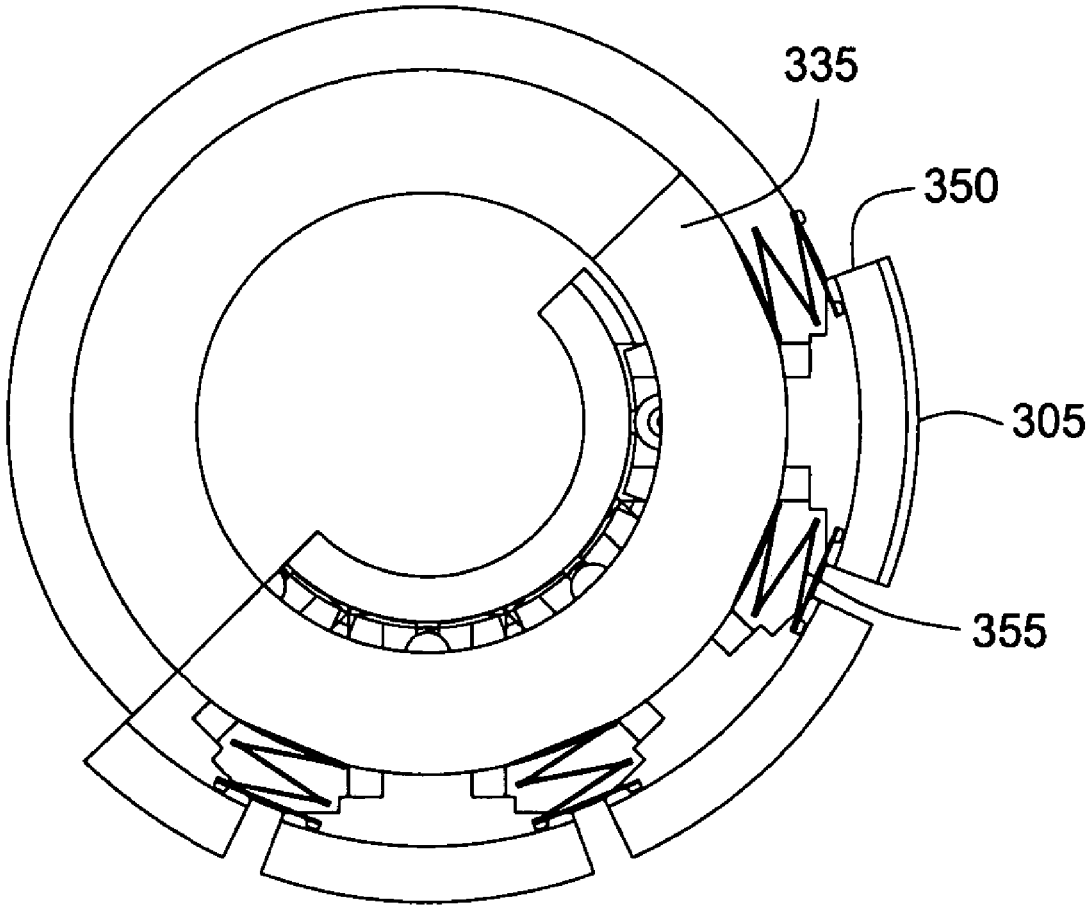
FIG. 9 is a cross-sectional view of another embodiment of a gripping element.

In another embodiment, the gripping element 305 may include a collar 350 on either side, instead of the upper or lower end. As shown in FIG. 9, a biasing member 355 is disposed between two adjacent gripping elements 305. Additionally, the biasing member 355 is between the side collars 350 and the body 335. In this respect, the biasing member 355 may be used to control the position of the gripping elements 305. In one embodiment, the biasing member 355 may comprise one or more retracting blade springs.

In another aspect, the torque head 40 may optionally employ a circulating tool 280 to supply fluid to fill up the casing 30 and circulate the fluid, as shown in FIG. 7. The circulating tool 220 may be connected to a lower portion of the mandrel 203 and at least partially disposed in the body 235. The circulating tool 280 includes a first end and a second end. The first end is coupled to the mandrel 203 and fluidly communicates with the top drive 15. The second end is inserted into the casing 30. A cup seal 285 is disposed on the second end interior to the casing 30. The cup seal 285 sealingly engages the inner surface of the casing 30 during operation. Particularly, fluid in the casing 30 may expand the cup seal 285 into contact with the casing 30. The circulating tool 280 may also include a nozzle 288 to inject fluid into the casing 30. The nozzle 288 may also act as a mud saver adapter for connecting a mud saver valve (not shown) to the circulating tool 280.

Tubular Conveying Apparatus

Figure 10:
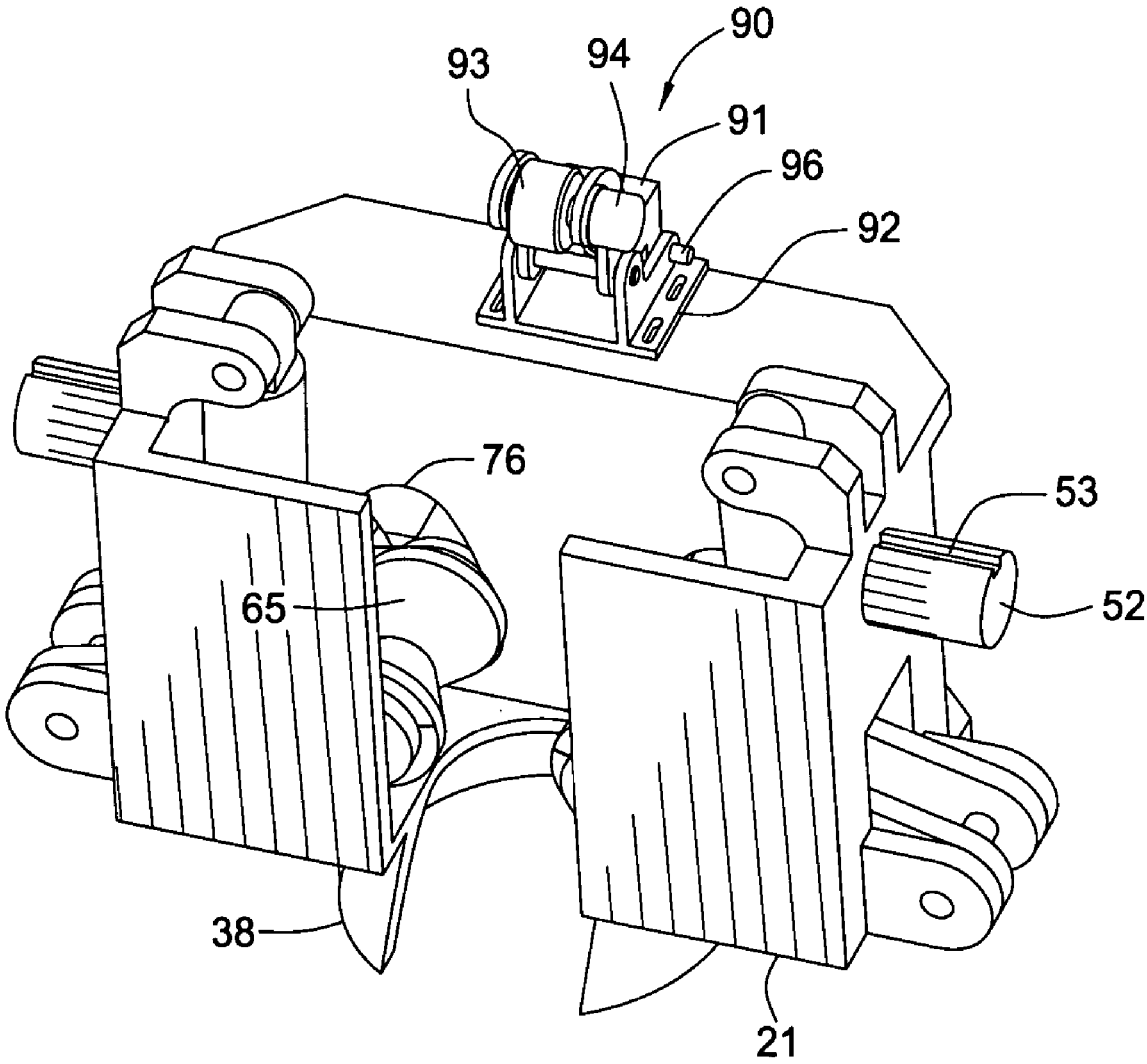
FIG. 10 is a perspective view of an embodiment of a casing feeder.

In another aspect, the top drive system is equipped with a casing feeder 20 to position the casing 30 for handling by the torque head 40. FIGS. 1A-1B show an exemplary embodiment of a casing feeder 20. The casing feeder 20 is suspended below the torque head 40 by two bails 22 coupled to the top drive 15. A shaft 52 (shown in FIG. 10) attached to each side of the housing 21 of the casing feeder 20 couples the casing feeder 20 to the eyes 23 of the bails 22. In one embodiment, the shafts 52 are connected to a swivel drive 45 adapted to rotate the casing feeder 20 relative to the bails 22. Preferably, the swivel drive 45 includes a hydraulic motor 46 and a bushing at its drive shaft. Torque of the motor 46 is transferred using a key inserted into the groove 53 of the shaft 52 of the casing feeder 20. In this respect, the casing feeder 20 may be rotated to the proper angle to facilitate the insertion of the casing 30 from the v-door or the rig floor. It is contemplated that other types of torque transferring mechanisms are equally applicable without deviating from the aspects of the present invention.

As shown in FIG. 1, the casing feeder 20 is open at the top and the bottom to allow axial movement of the casing 30 therethrough. In one embodiment, the opening 35 at the bottom of the casing feeder 20 is provided with a conical shaped guide 38 to assist with the insertion of the casing 30 into the casing feeder 20. If the casing 30 is not aligned with the opening, contact with the conical guide 38 will guide the casing 30 toward the opening for insertion into the casing feeder 20. Additionally, the front of the casing feeder 20 may be partially open for viewing and access to the interior of the casing feeder 20.

Figure 11:
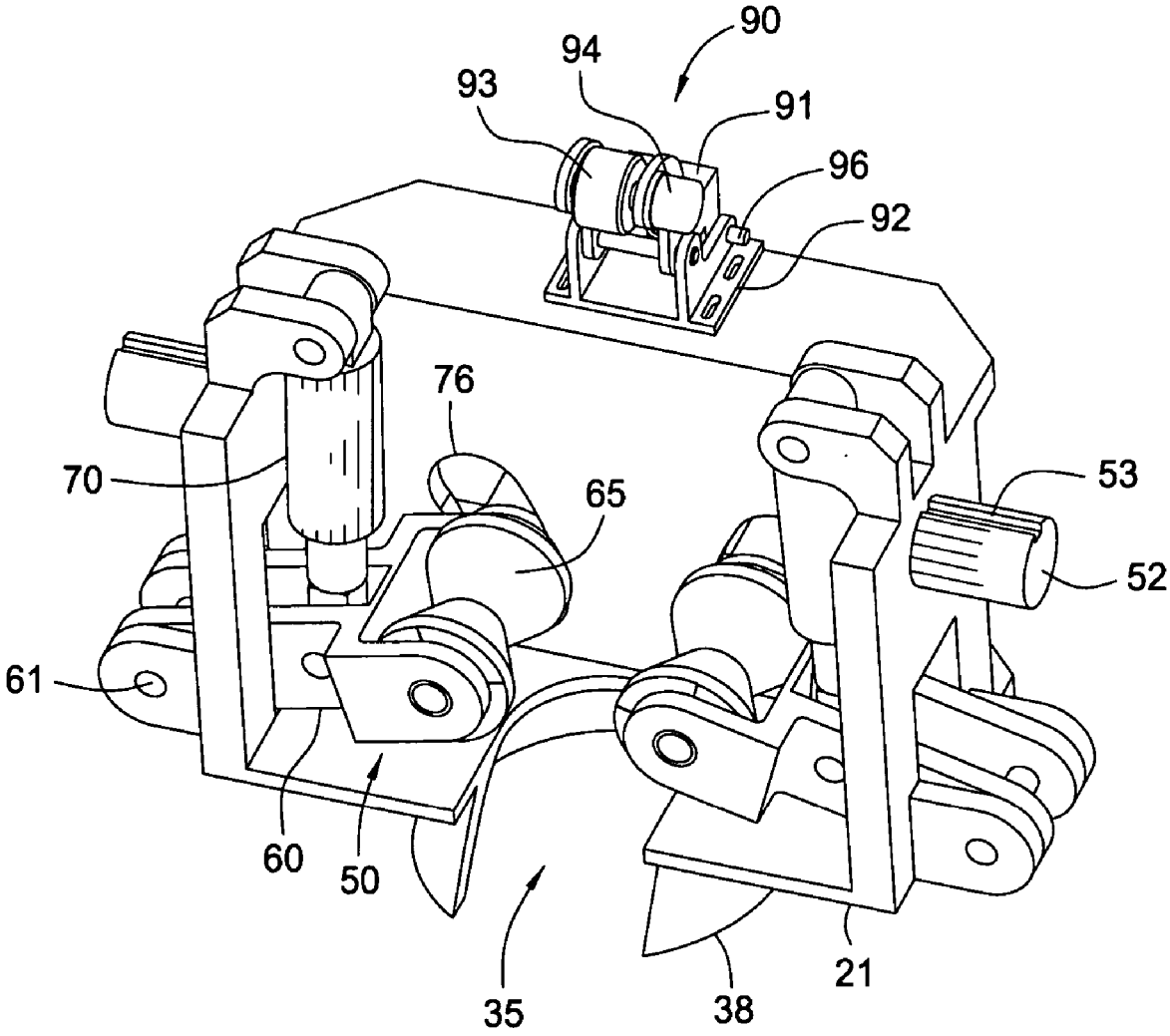
FIG. 11 is another perspective view of the casing feeder with a front panel removed.
Figure 12:
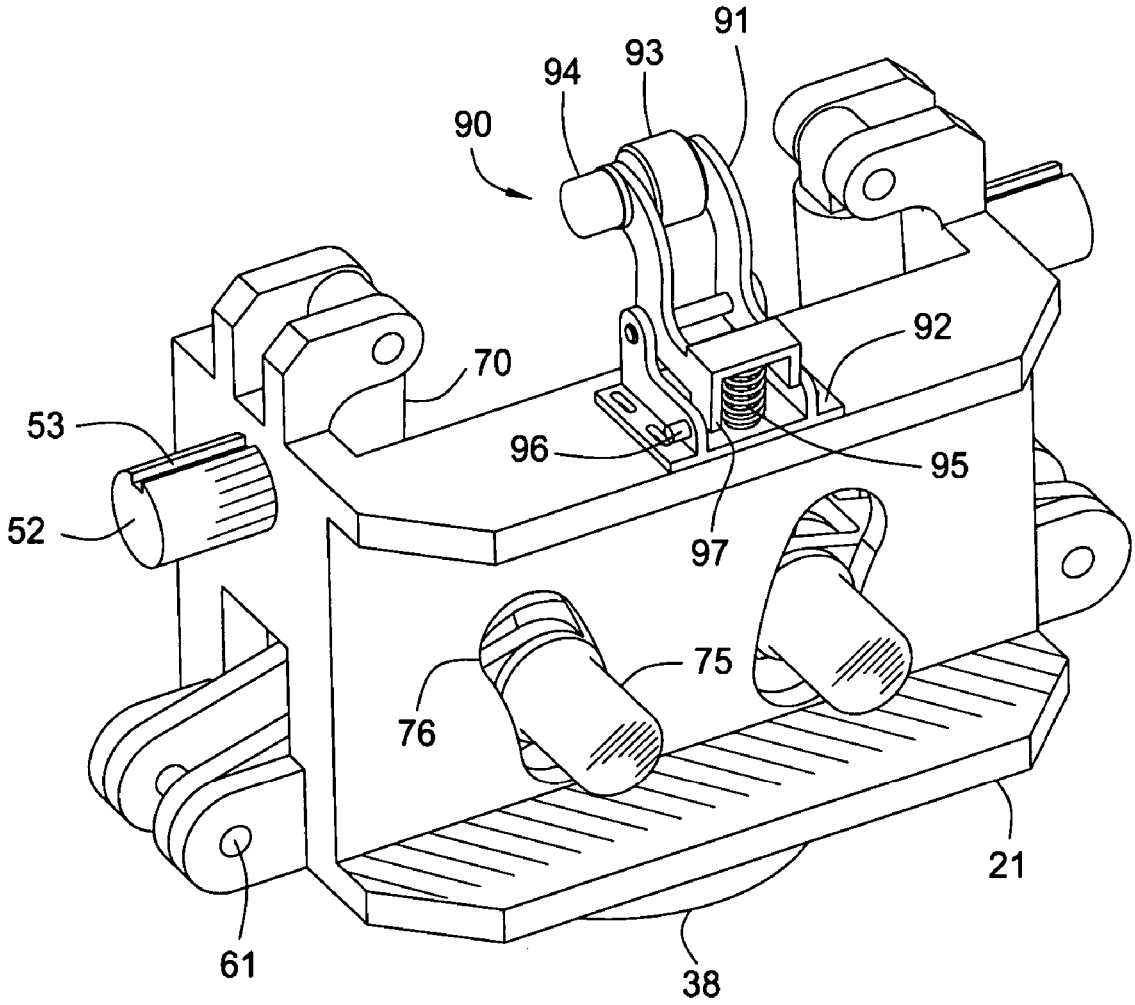
FIG. 12 is another perspective view of the casing feeder.
Figure 13:
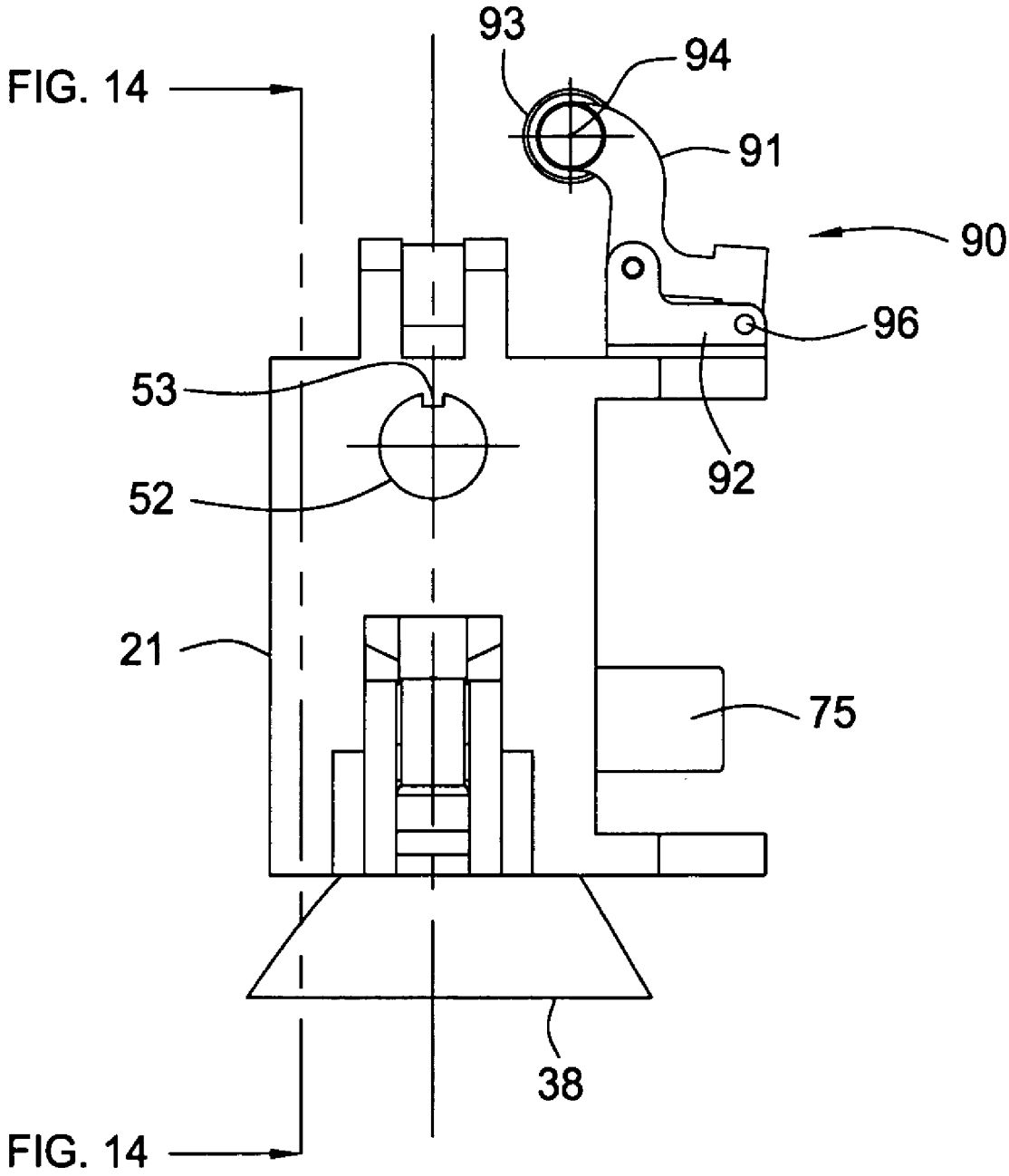
FIG. 13 is a side view of the casing feeder.
Figure 14:
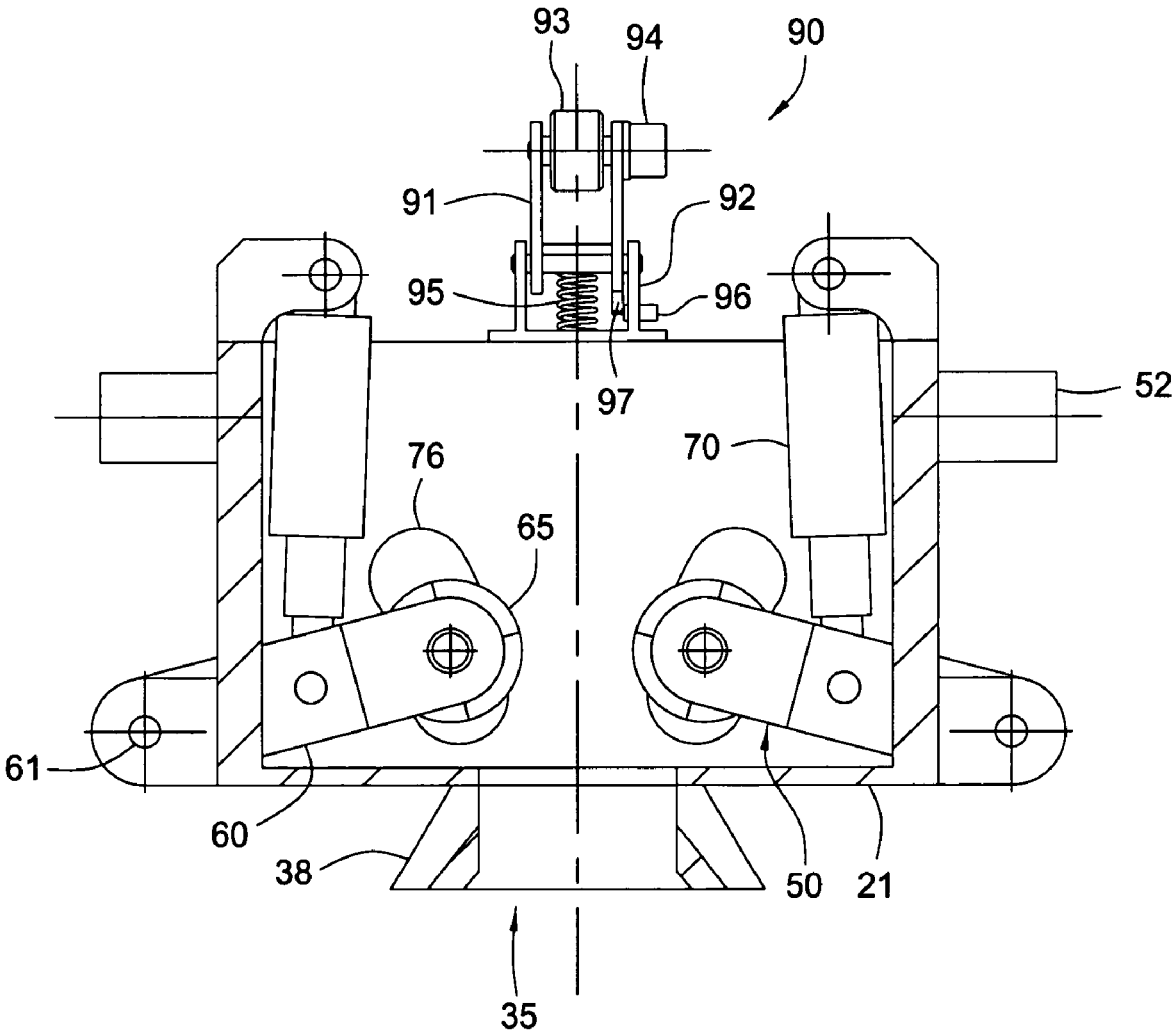
FIG. 14 is a cross-sectional view of the casing feeder.

The casing feeder 20 is adapted to axially move the casing 30 relative to the housing 21. FIGS. 10-14 show different views of the exemplary casing feeder 20 shown in FIG. 1A. As shown in FIG. 11, which is a perspective view of the casing feeder 20 with the front side removed, the casing feeder 20 includes a pair of conveying members 50. In one embodiment, the conveying member 50 comprises a conveying arm 60 and a roller 65. One end of each of the arms 60 is pivotally connected to the exterior of the housing 21 using a bolt 61. The other end of the arms 60 is equipped with a drive roller 65 for engaging the casing 30. The arms 60 are actuated by a pair of hydraulic cylinders 70 extending from an upper portion of the housing 21. In this respect, the conveying arms 60 act as levers to raise or lower the rollers 65. Preferably, movement of the conveying members 50 is synchronized. In one embodiment, a flow divider is provided to distribute the fluid source equally to the cylinders 70, thereby simultaneously actuating the cylinders 70. In another embodiment, mechanical parts, such as gears, may be used for synchronization of the lever arm movement. Other suitable methods of synchronizing the lever arm movement as is known to a person of ordinary skill are within the scope of the present invention.

The rollers 65 coupled to the conveying arms 60 may be driven by hydraulically driven motors 75. Guide slots 76 may be formed at the backside of the casing feeder 20 to accommodate the positioning and movement of the motors 75 as the conveying arms 60 are actuated by the cylinders 70. In one embodiment, the drive motors 75 of the rollers 65 are equipped with an integrated brake system. The motors 75 may be self locking by using a gear system. When the rollers 65 are locked or stopped, the weight of the casing 30 will press down on the conveying arms 60, thereby trapping casing 30 between the rollers 65. In situations where the hydraulic pressure of the cylinder 70 drops, the casing 30 will also stay in its position by pressing down on the conveying arms 60. Furthermore, if both the motor brakes fail and the hydraulic pressure drops, the casing 30 will slide down between the rollers 65 until the coupling 32 of the casing 30 come into contact with the rollers 65. Because the coupling 32 is generally larger in diameter than the casing 30, the coupling 32 will rest on the rollers 65 and stop the casing's 30 descent. In this respect, the casing feeder 20 reduces the likelihood of the inadvertent release of the casing 30. It must be noted that motors operated in other manners such as electrics and mechanics are also contemplated.

After the rollers 65 engage the casing 30, the drive motors 75 are actuated to rotate the rollers 65. Rotation of the rollers 65 lifts the casing 30 toward the torque head 40 for engagement therewith. In one embodiment, the rollers 65 have a smooth surface for frictionally engaging the casing 30. In another embodiment, the rollers are provided with a rough surface for engaging the casing 30. The rollers 65 will continue to move the casing 30 axially toward the torque head 40 until the top of the casing contacts a casing stop 80 in the torque head 40. Suitable casing stops 80 include a spring or a resilient material such as an elastomer. Preferably, the torque supplied by the drive motors 75 is only slightly higher than the torque required to lift the casing 30. As such, the drive motors 75 will stop automatically when the casing 30 contacts the casing stop 80.

In another aspect, the casing feeder 20 may be equipped with a counting apparatus 90 to ensure the proper positioning of the casing 30 in the torque head 40. In one embodiment, the counting apparatus 90 includes an actuating lever 91 pivotally coupled to a base 92 that is mounted to the top of the casing feeder 20. Particularly, base 92 couples to a middle portion of the actuating lever 91. The front portion of the actuating lever 91 faces toward the interior of the casing feeder 20 and is provided with a counting member and a counter 94. Preferably, the counting member comprises a roller 93 and the counter 94 is adapted to measure the number of revolutions of the counting roller 93. The back portion of the actuating lever 91 is coupled to a biasing member 95 adapted to bias the roller 93 toward the interior of the casing feeder 20 when the biasing member 95 is in the relaxed or unbiased position. A suitable biasing member 95 is a spring. The counting apparatus 90 also includes a sensor 96 for activating the counter 94. The sensor 96 may be a contact less sensor that is activated by the movement of a plate 97 attached to the back portion of the actuating lever 91.

As the casing 30 is being lifted by the rollers 65, the coupling 32 comes into contact with the counting roller 93. In turn, the counting roller 93 is pivoted away from the interior of the casing feeder 20, which causes the back portion of the actuating lever 91 to compress the spring 95. Additionally, the plate 97 is pivoted into position to cover the surface of the sensor 96, which acts as a start signal for the counter 94 to begin counting the revolutions of the counting roller 93 as the casing 30 is lifted up continuously. In this respect, the position of the casing 30 may be expressed as a function of the number of revolutions of the counting roller 93. When the drive motors 75 automatically stop due to contact of the casing 30 with the casing stop 80, the number of revolutions counted may be compared to a preset number of revolutions to determine if the casing 30 is properly placed in the torque head 40. One benefit of the counting apparatus 90 is that the counting is not affected by possible slippage of the drive rollers 65 during lifting. However, it must be noted that a counter may be adapted to count the number of revolutions of the drive rollers 65 as an alternative to a separate counting apparatus.

In operation, the top drive 15 may be lowered toward the rig floor to allow the bails 22 to swing the casing feeder 20 to the v-door of the rig to pick up a casing 30. The bails 22 may be actuated by a hydraulic cylinder that is often attached to the top drive 15. To facilitate the insertion of the casing 30 into the casing feeder 20, swivel drive motor 45 may be actuated to position the casing feeder 20 at the desired angle to receive the casing 30.

Once the casing 30 is inserted, the cylinders 70 are actuated to lower the conveying arms to engage the casing 30. Then, the top drive is lifted by the traveling block, thereby raising the casing feeder 20 and the casing 30. After the casing 30 is lifted off the ground, the casing feeder 20 and the casing 30 are swung toward the center of the well.

Thereafter, the drive rollers 65 are rotated to lift the casing 30 toward the torque head 40 for engagement therewith. When the coupling 32 contacts the counting roller 93, the counter 94 is caused to begin counting the number of rotations the counting roller 93 performs until the casing 30 stops. The casing 30 is stopped when it contacts the casing stop 80 in the torque head 40. If the counting roller 93 rotates about the same number of revolutions as a present amount, then the casing 30 is properly positioned in the torque head 40. In this manner, the casing 30 may be quickly and safely positioned for engagement with the torque head 40.

Figure 15:
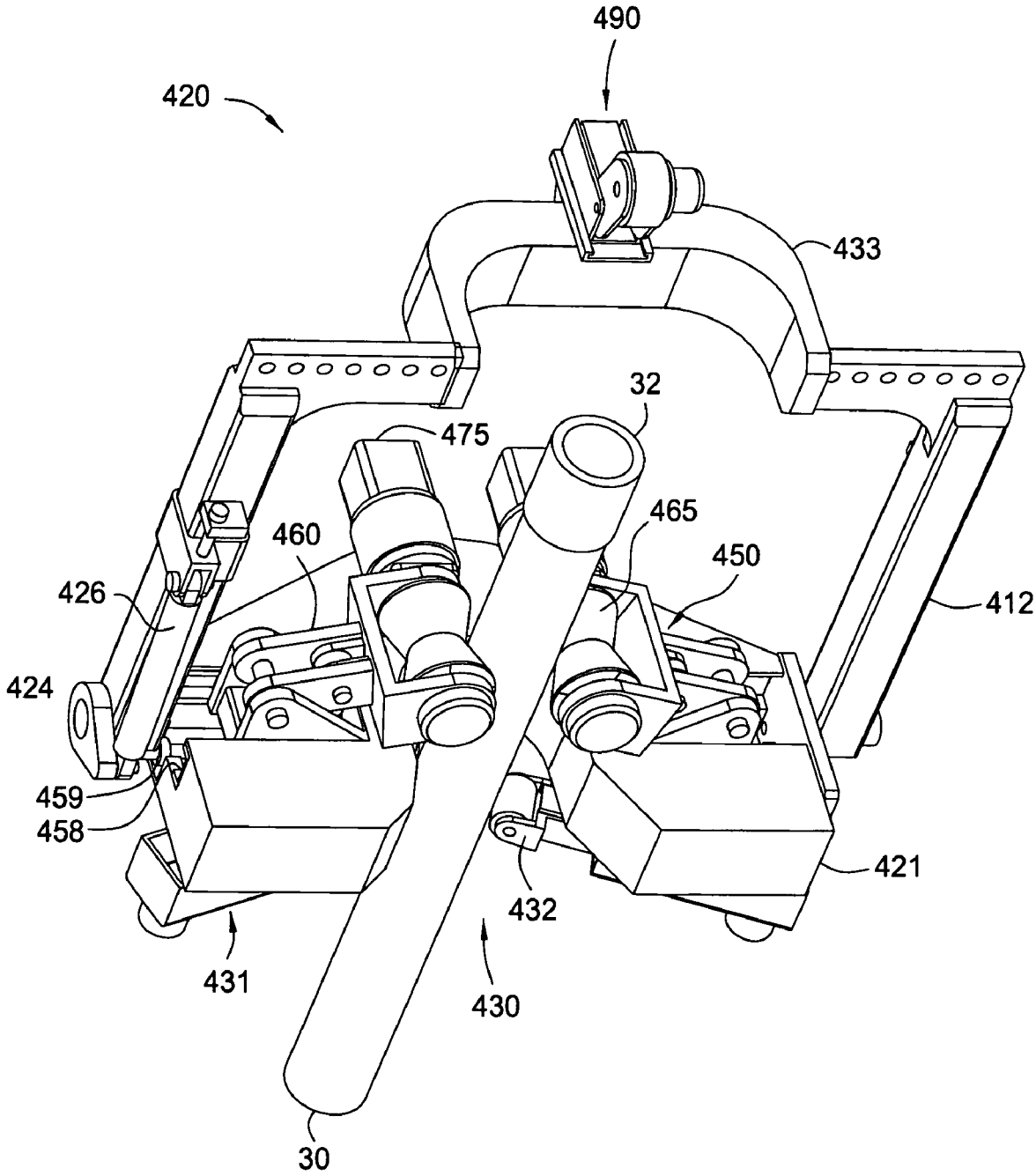
FIG. 15 shows another embodiment of a casing feeder.
Figure 16:
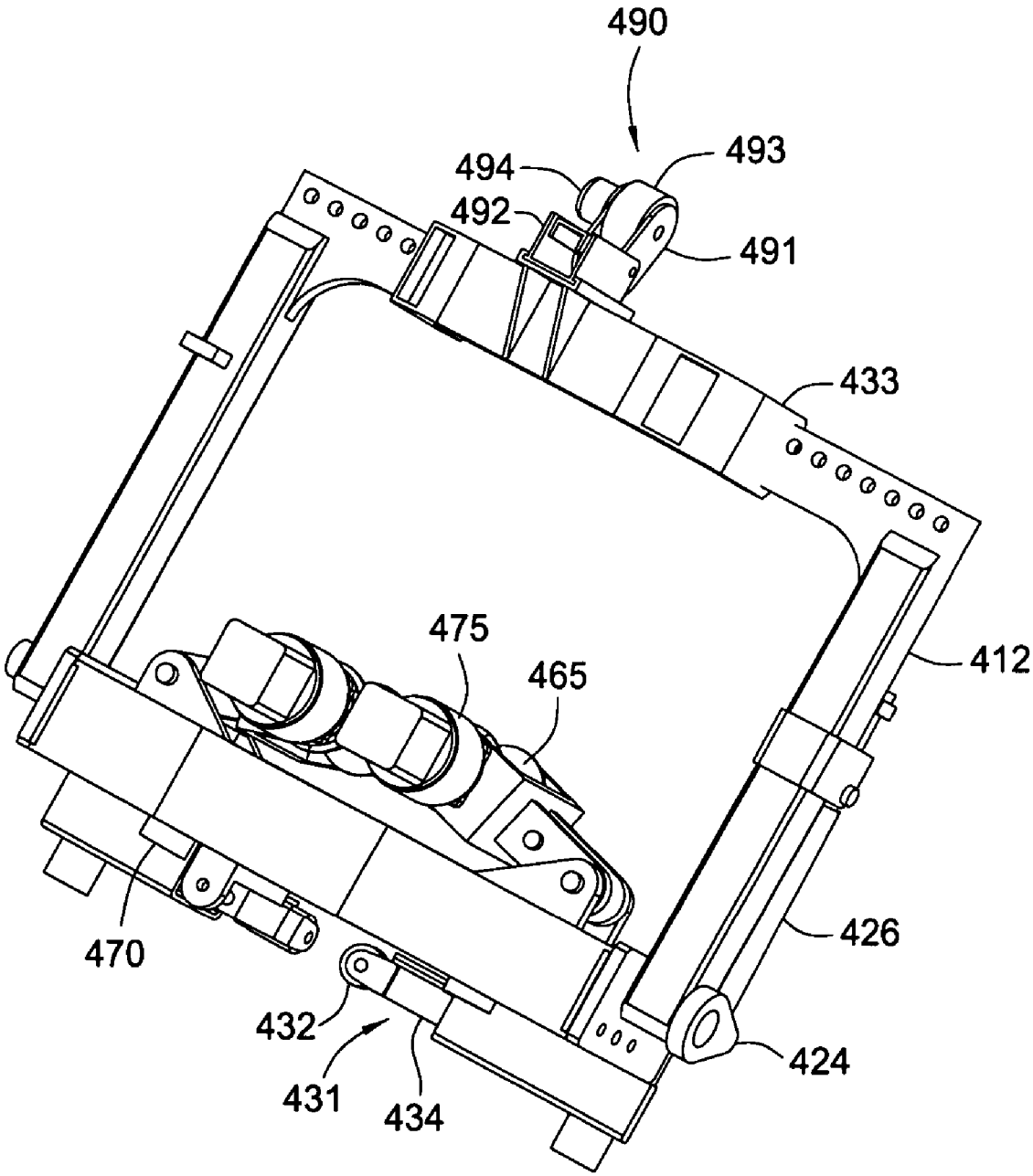
FIG. 16 is another perspective view of the casing feeder of FIG. 15.
Figure 17:
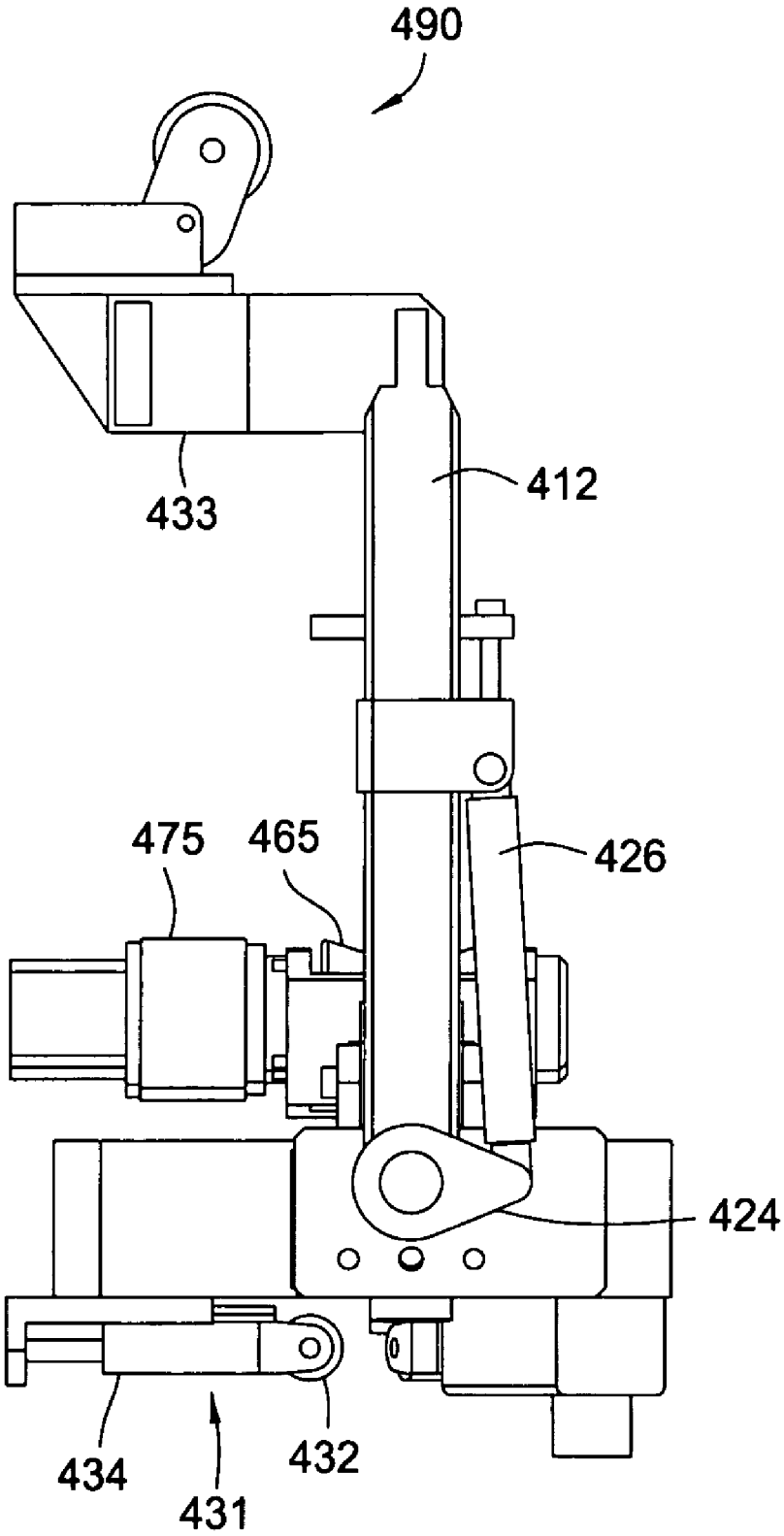
FIG. 17 is a side view of the casing feeder of FIG. 15.

FIGS. 15-17 show another embodiment of a tubular conveying apparatus for positioning a tubular. As shown in FIG. 15, the tubular conveying apparatus is a casing feeder 420 adapted to feed the casing into the torque head 40. The casing feeder 420 includes a housing 421 pivotally mounted to a support frame 412. A pivot member 424 attached to the housing 421 couples the housing 421 to a lower portion of the frame 412. The pivot member 424 is connected to the cylinder 426 attached to the frame 412. In this respect, extension or retraction of the cylinder 426 will cause the pivot member 424 to rotate. In turn, the housing 421 is caused to rotate relative to the frame 412. In this manner, the casing feeder 420 may be rotated to the proper angle to facilitate the insertion of the casing 30 from the v-door or the rig floor. Other suitable types of rotating mechanisms known to a person of ordinary skill in the art are also contemplated.

The housing 421 includes an opening 430 for the insertion and the removal of the tubular. In FIGS. 16 and 17, one or more guide members 431 are provided to facilitate movement of the tubular. In one embodiment, the guide members 431 comprise a roller 432 attached to the end of a cylinder assembly 434. As shown, three guide members 431 are positioned around the opening 430 for guiding the movement of the tubular. In one aspect, the cylinder assembly 434 may be actuated to extend the guide rollers 432 toward the opening 430 to engage the tubular, thereby assisting the alignment of the tubular for insertion into the torque head 40.

Figure 18A:
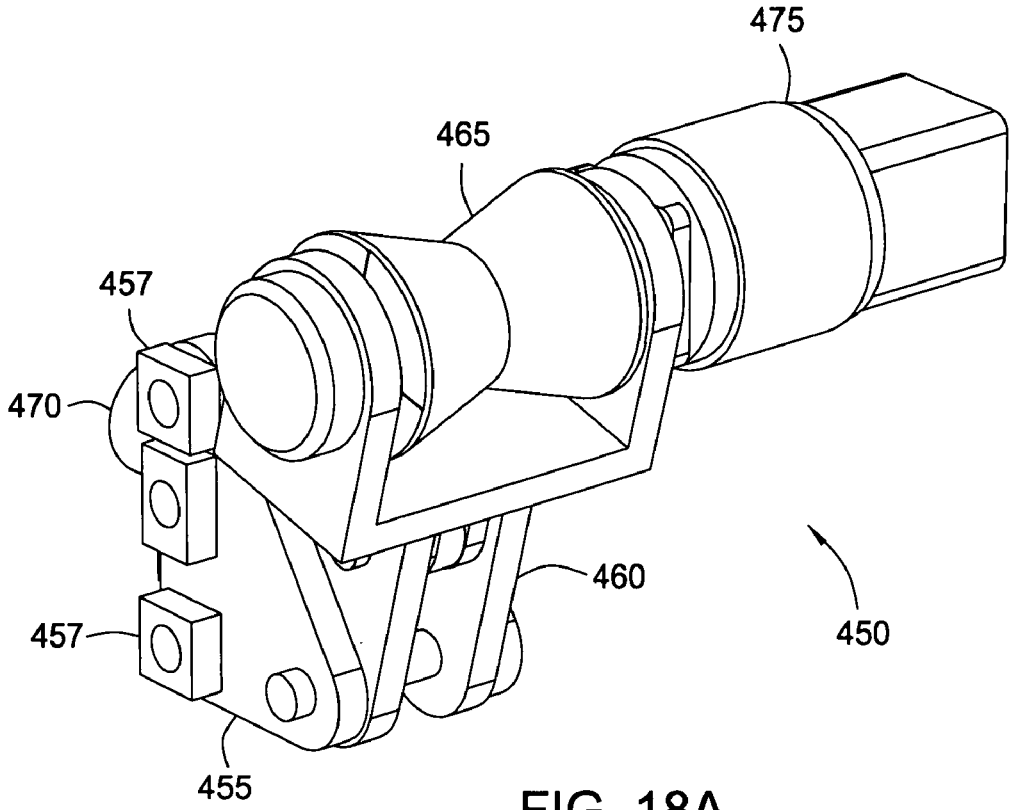
FIGS. 18A-B show an exemplary conveying member.
Figure 18B:
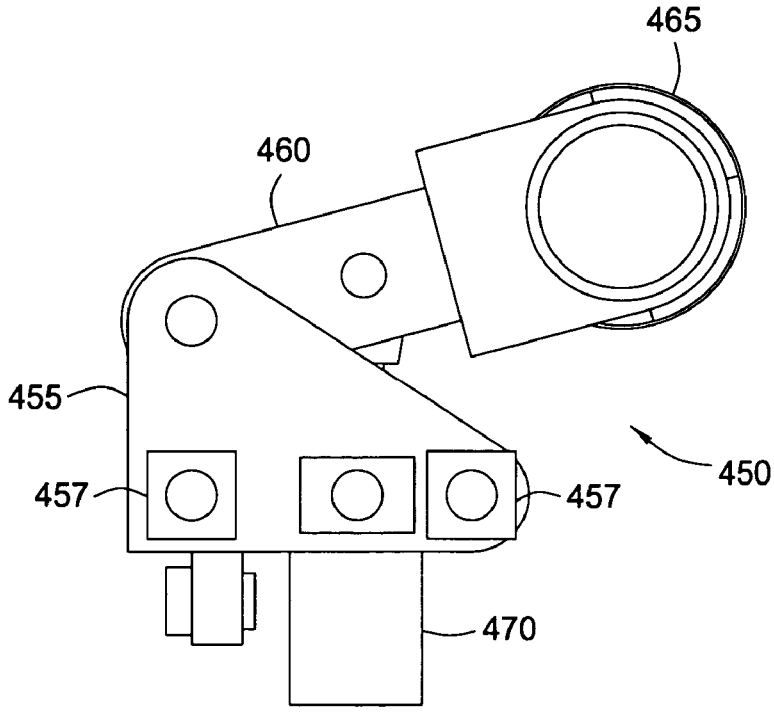

The casing feeder 420 is adapted to axially move the casing 30 relative to the frame 412, as illustrated in FIG. 15. The casing feeder 420 is equipped with one or more conveying members 450 for retaining and conveying the casing. In the preferred embodiment, the casing feeder 420 includes a pair of conveying members 450. Referring now to FIGS. 18A and 18B, the conveying member 450 includes a conveying arm 460 pivotally coupled to a support member 455. The conveying arm 460 is equipped with a retaining member such as a drive roller 465 for engaging the casing 30. Each conveying arm 460 is actuated by a hydraulic clamping cylinder 470. One end of the cylinder 470 may be pivotally coupled to the conveying arm 460, and the other end of the cylinder 470 may be movably connected to the support member 455. As shown, the cylinder 470 is movable relative to the support member 455 between two guide blocks 457. In this respect, the cylinder 470 is allowed to adjust for changes in its position as a result of raising or lowering the conveying arm 460. As shown in FIG. 16, a slot may be formed in the housing 421 to accommodate the cylinder 470. In the preferred embodiment, movement of the conveying arms 460 is synchronized. In one embodiment, a flow divider is provided to distribute the fluid source equally to the cylinders 470, thereby simultaneously actuating the cylinders 470. In another embodiment, mechanical parts, such as gears, may be used for synchronization of the conveying arm movement. Other suitable methods of synchronizing the conveying arm movement as is known to a person of ordinary skill are within the scope of the present invention. Although a fluid operated cylinder 470 is preferred, other types of cylinders known to a person of ordinary skill in the art are also contemplated.

Referring back to FIG. 18, the rollers 465 coupled to the conveying arms 460 may be driven by hydraulic motors 475. In one embodiment, the drive motors 475 of the rollers 465 are equipped with an integrated brake system. An exemplary drive motor 475 includes a standard winch drive. When the rollers 465 are locked or stopped, the weight of the casing 30 will press down on the conveying arms 460, thereby trapping the casing 30 between the rollers 465. In situations where the hydraulic pressure of the cylinder 470 drops, the casing 30 will also stay in its position by pressing down on the conveying arms 460. Furthermore, if both the motor brakes fail and the hydraulic pressure drops, the casing 30 will slide down between the rollers 465 until the coupling 32 of the casing 30 come into contact with the rollers 465. Because the coupling 32 is generally larger in diameter than the casing 30, the coupling 32 will rest on the rollers 465 and stop the casing's 30 descent. In this respect, the casing feeder 420 reduces the likelihood of the inadvertent release of the casing 30. It must be noted that motors operated in other manners such as electric and mechanic are also contemplated.

In one embodiment, the support member 455 is disposed in a recessed portion of the housing 421, as illustrated in FIG. 15. In one embodiment, the conveying member 450 is adjustable to accommodate casings or tubulars of different sizes. As shown in FIG. 15, the support member 455 is disposed on a track 458 in the recessed portion of the housing 421 and is connected to a spindle 459. A suitable example of a spindle 459 includes a piston and cylinder assembly. The spindle 459 may be actuated to move the support member 455 along the track 458, thereby moving the conveying member 450 relative to the opening 430 of the casing feeder 420. In this respect, the conveying member 450 may be adjusted to handle tubulars of various diameters.

In another embodiment, the casing feeder 420 is optionally equipped with a counting apparatus 490 to ensure the proper positioning of the casing 30 in the torque head 40. The counting apparatus 490 is disposed on a bridge 433 positioned above the housing 421. As illustrated in FIG. 16, the counting apparatus 490 includes an actuating lever 491 pivotally coupled to a base 492 that is mounted to the bridge 433. The front portion of the actuating lever 491 faces the opening 430 of the housing 421 and is provided with a counting member and a counter 494. Preferably, the counting member comprises a roller 493 and the counter 494 is adapted to measure the number of revolutions of the counting roller 493. The back portion of the actuating lever 491 is coupled to a biasing member adapted to bias the roller 493 toward the opening 430 of the casing feeder 420 when the biasing member is in the relaxed or unbiased position. A suitable biasing member is a spring. The counting apparatus 490 may also include a sensor for activating the counter 494. The sensor may be a contactless sensor that is activated when the tubular contacts the counting roller 493.

Figure 19:
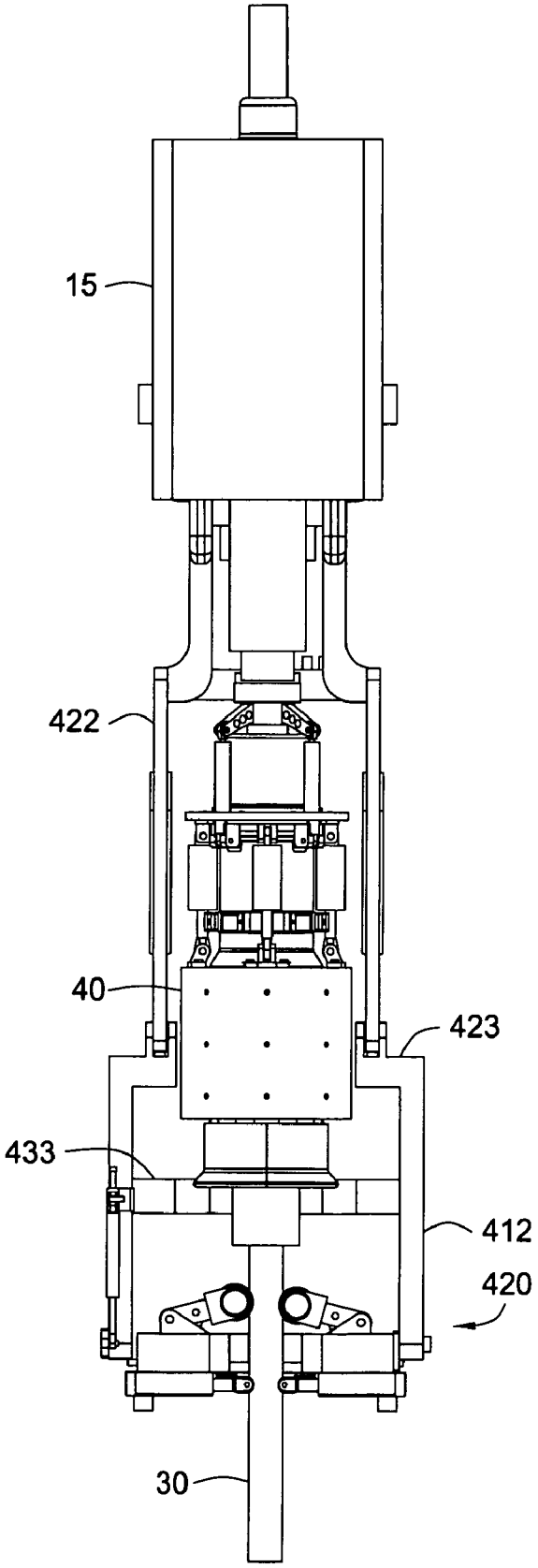
FIG. 19 shows an exemplary top drive system equipped with a casing feeder.
Figure 20:
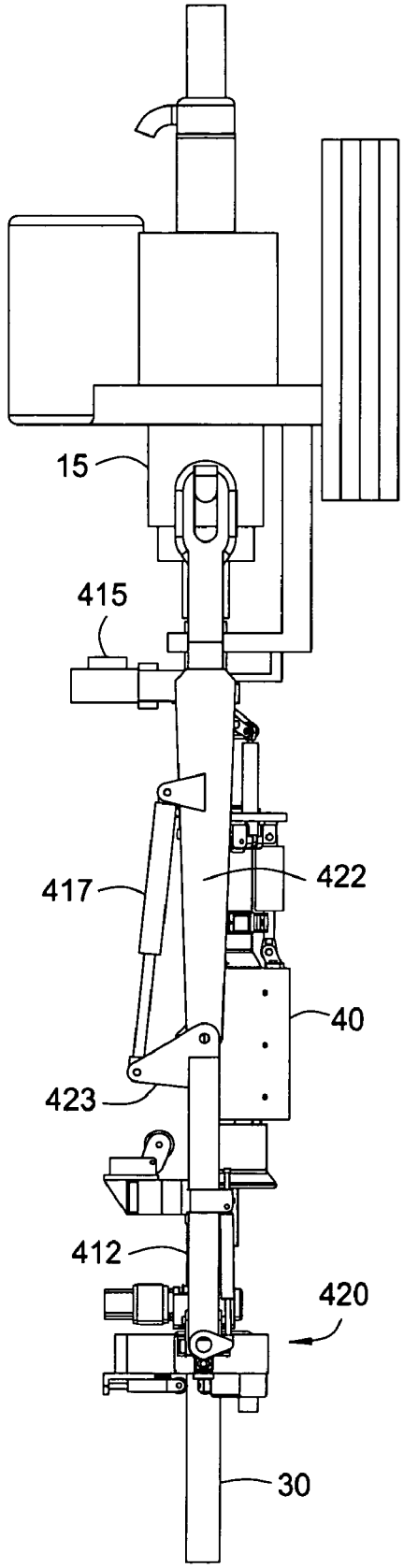
FIG. 20 is a side view of the top drive system of FIG. 19.
Figure 21:
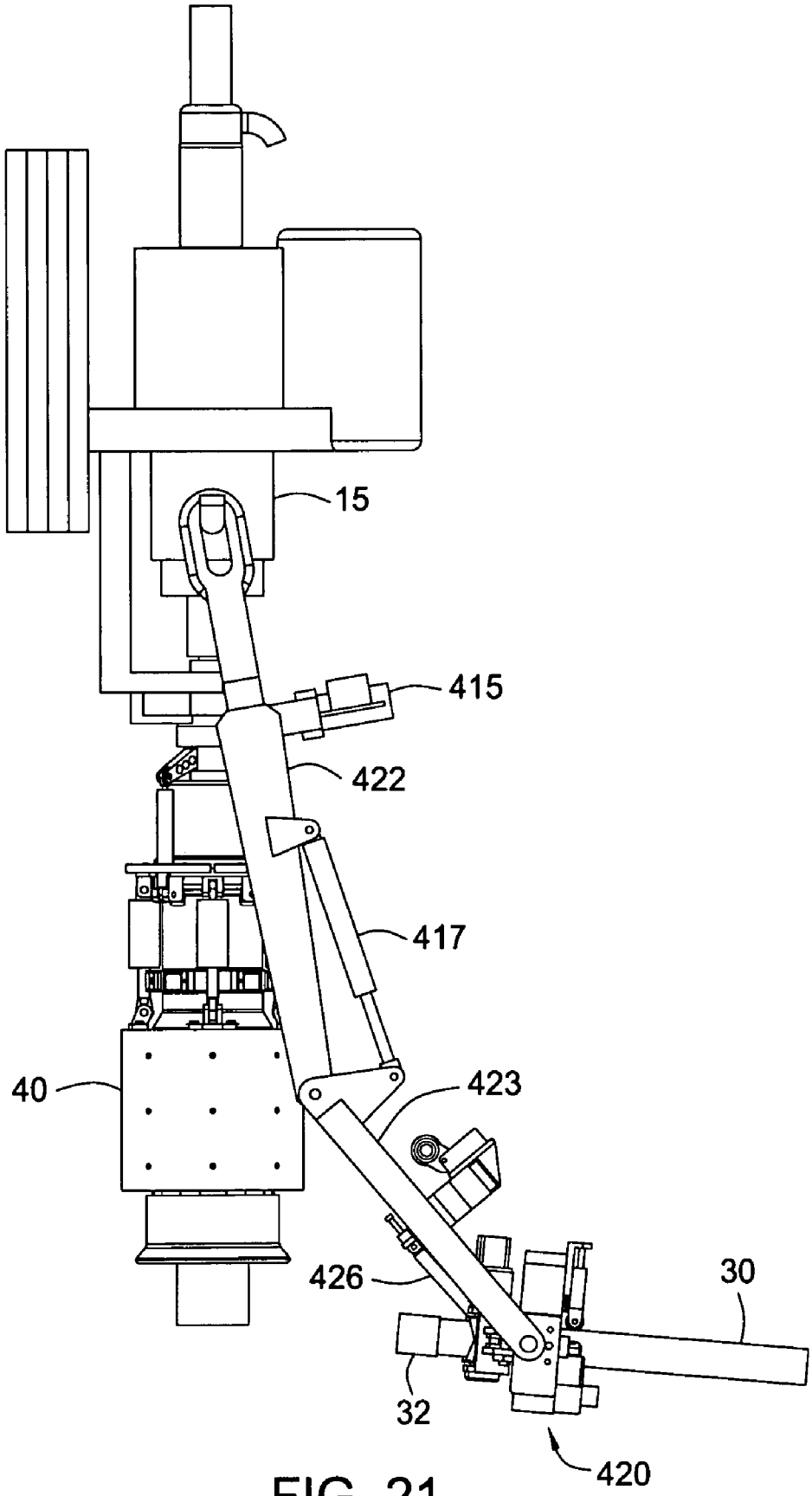
FIG. 21 shows the top drive system of FIG. 19 in operation.

FIGS. 19 and 20 show an exemplary embodiment of a top drive system for drilling with casing. A torque head 40 is connected to a lower portion of the top drive 15 and is disposed between two bails 422. A cylinder 415 attached to the side of the bails 422 is positioned against the top drive 15. When the cylinder 415 is extended against the top drive 15, the bails 422 are pivoted relative to the top drive 15, as illustrated in FIG. 21. A connection member 423 is provided to couple the bails 422 to the frame 412 of the casing feeder 420. As shown, the connection members 423 are adapted to allow the frame 412 to pivot relative to the bails 422. Cylinders 417 are provided to pivot the frame 412 relative to the bails 422. In one embodiment, the cylinder 417 is attached to the bail 422 at one end and the connection member 423 at another end. Preferably, the connection member 423 acts like a lever such that extension or retraction of the cylinder 417 pivots the frame 412 relative to the bails 422, as shown in FIG. 21. It must be noted that a spear, as is known to a person of ordinary skill in the art, may be coupled to the top drive instead of the torque head.

In operation, the top drive 15 may be lowered toward the rig floor to allow the bails 422 to swing the casing feeder 420 to the v-door of the rig to pick up a casing 30. Initially, the bails 422 are pivoted away from the top drive 15, as illustrated in FIG. 21. Additionally, the frame 412 is pivoted relative to the bails 422 by actuating the respective cylinder 417. Also, the housing 421 is pivoted relative to the frame 412 so that the tubular may be inserted into the opening 430.

Figure 22:
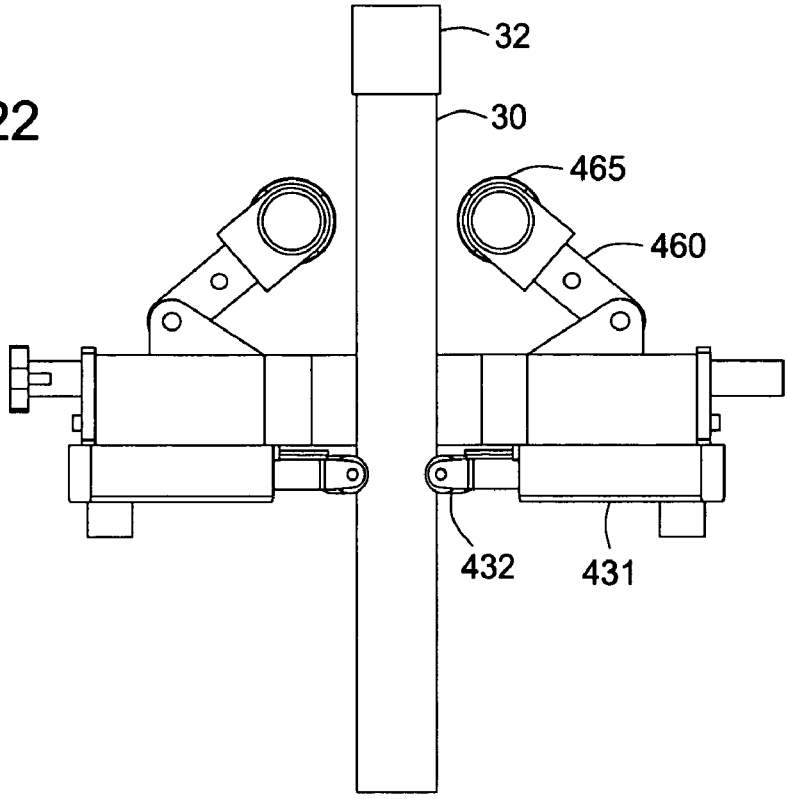
FIG. 22 shows the casing feeder before engagement with casing.
Figure 23:
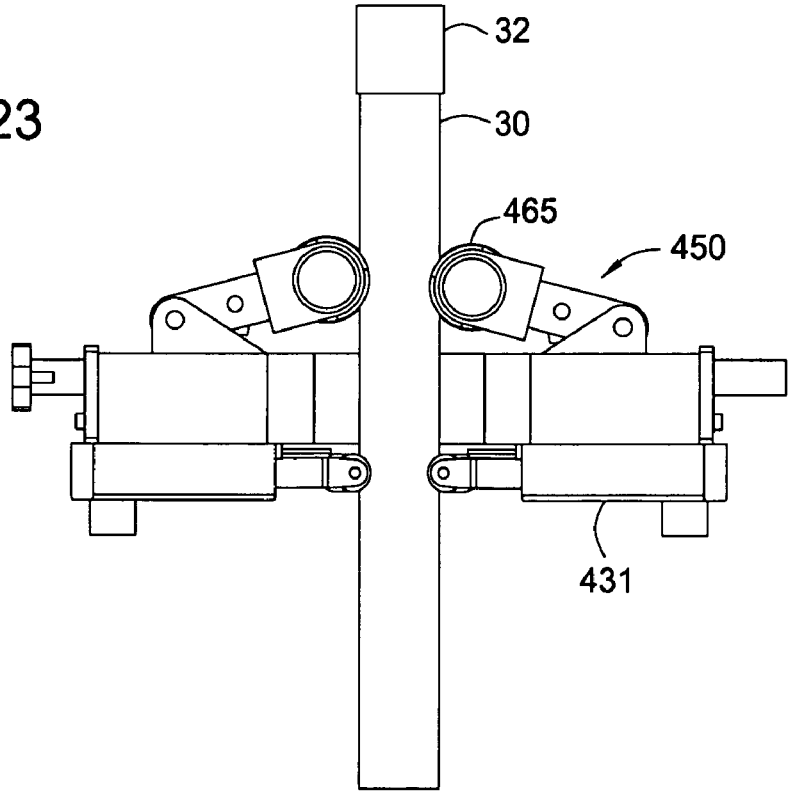
FIG. 23 shows casing feeder engaged with the casing.

Once the casing 30 is inserted, the clamping cylinders 470 are actuated to lower the conveying arms 460 to engage the casing 30. FIG. 22 shows the position of the conveying arms and the rollers before engagement with the casing 30. It can also be seen that the guide rollers 432 of the guide members 431 are engaged with the casing 30. In FIG. 23, the clamp rollers 465 have been lowered into engagement with the casing 30 at a location below the coupling. Thereafter, the top drive 15 is lifted by the traveling block, thereby raising the casing feeder 420 and the casing 30. After the casing 30 is lifted off the ground, the casing feeder 420 and the casing 30 are swung toward the center of the well.

Figure 24:
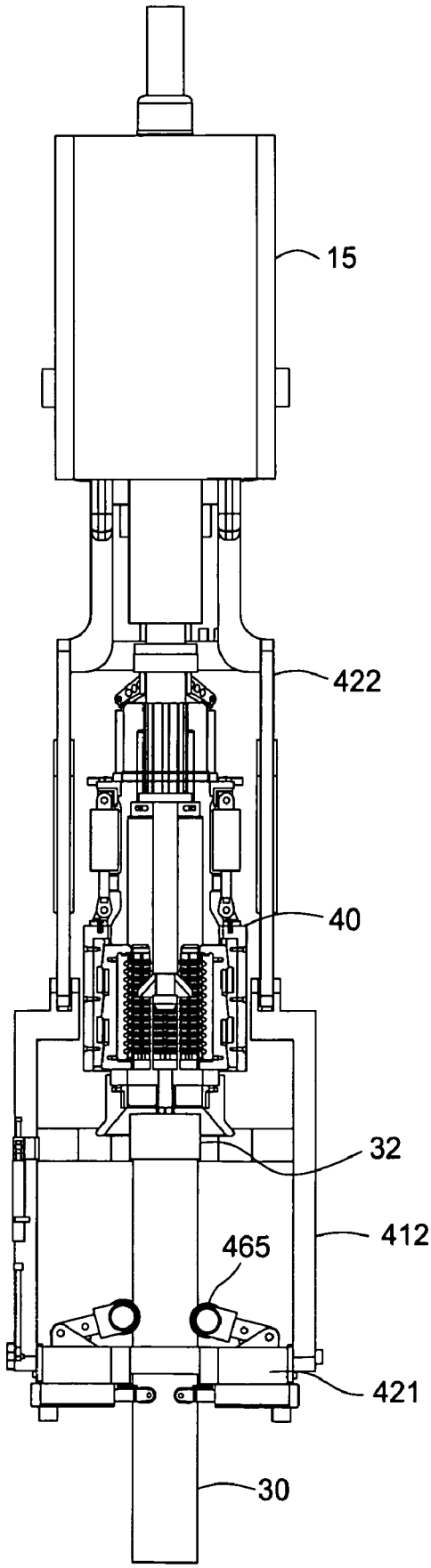
FIG. 24 shows the casing being lifted toward the torque head.

In FIG. 24, the housing 421, the frame 412, and the bails 422 are positioned in alignment with the top drive 15. Now, the drive rollers 465 are rotated by the drive motors 475 to lift the casing 30 toward the torque head 40 for engagement therewith. When the coupling 32 contacts the counting roller 493, the counter 494 is caused to begin counting the number of rotations the counting roller 493 performs until the casing 30 stops. The casing 30 is stopped when it contacts the casing stop 80 in the torque head 40. If the counting roller 493 rotates about the same number of revolutions as a present amount, then the casing 30 is properly positioned in the torque head 40. In this manner, the casing 30 may be quickly and safely positioned for engagement with the torque head 40.

In another embodiment, the casing feeder may comprise an elevator equipped with one or more conveying members. For example, the elevator may have a body with a bore therethrough for receiving a tubular. The body includes a pair of retaining arms that may be actuated to open and close the elevator. The conveying members are connected to a lower portion of the elevator. A cylinder may be provided to move the conveying members radially into engagement with the tubular retained by the elevator. After engagement, actuation of the drive motor will rotate the rollers of the conveying member, thereby lifting the tubular toward the torque head.

In another embodiment, the casing feeder may comprise a combination of an elevator adapted to support the weight of the casing string and conveying members adapted to translate the casing string. For example, the elevator may include slip type gripping members disposed on a bowl for engaging the casing. The slips may be adapted to support the weight of the casing string when the casing string is suspended from the elevator, and disengage the casing string when the casing string is lifted from the elevator. In this respect, the casing string may be supported by the elevator until the conveying members are activated to raise the casing string.

In addition to casing, aspects of the present invention are equally suited to handle tubulars such as drill pipe, tubing, and other types of tubulars known to a person of ordinary skill in the art. Moreover, the tubular handling operations contemplated herein may include connection and disconnection of tubulars as well as running in or pulling out tubulars from the well.

While the foregoing is directed to embodiments of the present invention, other and further embodiments of the invention may be devised without departing from the basic scope thereof, and the scope thereof is determined by the claims that follow.

I claim:

1. A top drive system for handling a tubular, comprising:

a top drive;

a tubular gripping member coupled to the top drive, the tubular gripping member capable of gripping the tubular and transferring torque from the top drive to the tubular; and a tubular conveying apparatus operatively coupled to the top drive, the tubular conveying apparatus further comprising a retaining member in contact with the tubular, wherein the tubular conveying apparatus is adapted to move the tubular relative to the retaining member and into engagement with the tubular gripping member, and wherein the gripping member and the conveying apparatus are actuatable independently of each other.

2. The system of claim 1, wherein the tubular gripping member comprises:

a housing operatively connected to the top drive;

a plurality of gripping elements radially disposed in the housing for engaging the tubular, wherein moving the housing relative to the plurality of gripping elements causes the plurality of gripping members to engage the tubular.

3. The system of claim 2, further comprising one or more engagement members disposed on the plurality of gripping elements.

4. The system of claim 3, wherein the one or more engagement members are pivotable.

5. The system of claim 4, further comprising a retracting mechanism for retracting the engagement members.

6. The system of claim 4, wherein an axial load acting on the engagement members causes the engagement members to pivot.

7. The system of claim 1, wherein the tubular conveying apparatus, comprises:

a pair of arms coupled to the retaining member for engaging the tubular, the arms actuatable to engage the tubular between the retaining member of each arm; and a motor for rotating the roller, thereby conveying the tubular relative to the conveying apparatus.

8. The system of claim 7, wherein the tubular gripping member comprises:

a housing operatively connected to the top drive;

a plurality of gripping elements radially disposed in the housing for engaging the tubular, wherein moving the housing relative to the plurality of gripping elements causes the plurality of gripping members to engage the tubular.

9. The system of claim 7, wherein the retaining member comprises a roller.

10. The system of claim 1, further comprising one or more bails coupling the conveying apparatus to the top drive.

11. The system of claim 10, further comprising a swivel drive system for rotating the conveying apparatus.

12. The system of claim 1, wherein the tubular gripping member comprises a tubular stop member.

13. The system of claim 1, wherein the tubular gripping member is adapted to grip an exterior surface of the tubular.

14. The system of claim 1, wherein the tubular gripping member is adapted to grip an interior surface of the tubular.

15. The system of claim 1, wherein the tubular is moved relative to the tubular conveying apparatus into engagement with the tubular gripping member.

16. The system of claim 1, wherein the tubular conveying apparatus is movable with the top drive.

17. The system of claim 1, wherein the tubular conveying apparatus further comprises a lever member.

18. The system of claim 1, further comprising a cylinder adapted to tilt the one or more bails.

19. The method of claim 1, further comprising a counting apparatus.

20. The method of claim 19, wherein the counting apparatus comprises a sensor for activating a counter.

21. The method of claim 20, wherein the counting apparatus further comprises a counting member for determining a position of the tubular.

22. The method of claim 21, wherein the counting member comprises a counting roller.

23. The method of claim 22, wherein the counter determines a number of revolutions performed by the counting roller.

24. The method of claim 23, wherein the number of revolutions is a function of the position of the tubular.

25. The method of claim 1, wherein the tubular comprises a casing.

26. A method for handling tubulars using a top drive, comprising:

providing a first tubular gripping member and a second tubular gripping member coupled to a top drive;

retaining the tubular using the second gripping member and moving the second gripping member to place the tubular into alignment with the first gripping member, the second gripping member comprising a retaining member in contact with the tubular;

moving the tubular relative to the retaining member of the second gripping member for engagement with the first gripping member; and rotating the tubular using the top drive.

27. The method of claim 26, wherein the second gripping member includes a drive mechanism.

28. The method of claim 27, further comprising actuating the drive mechanism to move the tubular into engagement with the first gripping member.

29. The method of claim 26, wherein the rotating the tubular comprises rotating the first tubular gripping member.

30. The method of claim 26, wherein the tubular is moved axially relative to the second gripping member.

31. The method of claim 30, wherein the second gripping member includes a drive mechanism for moving the tubular.

32. The method of claim 31, further comprising actuating the drive mechanism to move the tubular into engagement with the first gripping member.

33. The method of claim 30, wherein rotating the tubular comprises rotating the first tubular gripping member.

34. The method of claim 30, wherein the tubular is moved axially relative to the first gripping member.

35. The method of claim 30, further comprising axially moving the second gripping member along with the top drive.

36. The method of claim 26, wherein the tubular is moved axially relative to the first gripping member.

37. The method of claim 26, further comprising axially moving the second gripping member along with the top drive.

38. The method of claim 26, further comprising pivoting the retaining member in one plane to cause the retaining member to engage the tubular.

39. The method of claim 26, further comprising a bail for coupling the second gripping member to the top drive.

40. The method of claim 39, wherein the tubular is moved axially relative to the bail.

41. The method of claim 26, further comprising gripping the tubular using the first gripping member.

42. The method of claim 41, further comprising releasing the tubular from the second gripping member.

* * * * *

UNITED STATES PATENT AND TRADEMARK OFFICE

CERTIFICATE OF CORRECTION

PATENT NO. : 7,669,662 B2
APPLICATION NO. : 11/185281
DATED : March 2, 2010
INVENTOR(S) : Pietras It is certified that error appears in the above-identified patent and that said Letters Patent is hereby corrected as shown below:

In the References Cited (56):

Please delete "3,606,684 A 9/1971 Weiner" and insert --3,606,664 A 9/1971 Weiner-- therefor;

Please delete "WO 95-10888 4/1995" and insert --WO 95-10686 4/1995-- therefor;

In the Claims:

Column 16, Claim 19, Line 51, please delete "method" and insert --system-- therefor;

Column 16, Claim 20, Line 53, please delete "method" and insert --system-- therefor;

Column 16, Claim 21, Line 55, please delete "method" and insert --system-- therefor;

Column 16, Claim 22, Line 58, please delete "method" and insert --system-- therefor;

Column 16, Claim 23, Line 60, please delete "method" and insert --system-- therefor;

Column 16, Claim 24, Line 63, please delete "method" and insert --system-- therefor;

Column 16, Claim 25, Line 65, please delete "method" and insert --system-- therefor.

Signed and Sealed this

Twenty-eighth Day of September, 2010

David J. Kappos

David J. Kappos
*Director of the United States Patent and Trademark Office*